US007583168B2

(12) United States Patent
Kawai et al.

(10) Patent No.: US 7,583,168 B2
(45) Date of Patent: Sep. 1, 2009

(54) RESONATOR

(75) Inventors: Kunihiro Kawai, Yokohama (JP); Hiroshi Okazaki, Yokosuka (JP); Shoichi Narahashi, Yokohama (JP)

(73) Assignee: NTT DoCoMo, Inc., Tokyo (JP)

( * ) Notice: Subject to any disclaimer, the term of this patent is extended or adjusted under 35 U.S.C. 154(b) by 176 days.

(21) Appl. No.: 11/245,126

(22) Filed: Oct. 7, 2005

(65) Prior Publication Data

US 2006/0087388 A1 Apr. 27, 2006

(30) Foreign Application Priority Data

Oct. 27, 2004 (JP) ..... 2004-312536

(51) Int. Cl.
*H01P 1/20* (2006.01)

(52) U.S. Cl. ..... 333/238; 333/205; 333/33

(58) Field of Classification Search ..... 333/33, 333/238, 246, 262, 263, 204, 205, 219, 235
See application file for complete search history.

(56) References Cited

U.S. PATENT DOCUMENTS

| | | | |
|---|---|---|---|
| 4,211,977 | A | 7/1980 | Shinkawa et al. |
| 4,275,366 | A | 6/1981 | Schwarzmann |
| 4,618,838 | A | 10/1986 | Kajiwara et al. |
| 5,140,382 | A | 8/1992 | Shiga |
| 6,043,727 | A | 3/2000 | Warneke et al. |
| 6,307,452 | B1 | 10/2001 | Sun |

FOREIGN PATENT DOCUMENTS

| | | |
|---|---|---|
| EP | 0 849 820 A2 | 6/1998 |
| EP | 1 562 253 A1 | 8/2005 |
| JP | 61-19202 | 1/1986 |
| JP | 5-251914 | 9/1993 |
| JP | 6-61092 | 3/1994 |
| JP | 7-321509 | 12/1995 |
| JP | 2000-124713 | 4/2000 |
| JP | 2001-185973 | 7/2001 |

(Continued)

OTHER PUBLICATIONS

Patent Abstracts of Japan, JP 02-060303, Feb. 28, 1990.

(Continued)

*Primary Examiner*—Stephen E Jones
(74) *Attorney, Agent, or Firm*—Oblon, Spivak, McClelland, Maier & Neustadt, P.C.

(57) ABSTRACT

An object of the present invention is to provide a resonator capable of constituting a variable filter which has a small size, high mass productivity, low loss and high reproducibility of frequency. According to the present invention, a resonator having a line structure formed on a dielectric substrate 2, is reduced in size by providing a counter electrode 6 in the direction perpendicular to a surface of a resonant line 4 for forming a capacitive reactance which is added to the resonance circuit. The resonator can be further reduced in size by providing widened parts *7a*, *7b* on the resonant line with the use of the skin effect of an electric signal propagating in the resonant line, so as to enable a large capacitive reactance to be obtained, and by providing the widened parts and the counter electrodes for a part on the resonant line where a magnitude of voltage standing wave is high.

21 Claims, 24 Drawing Sheets

FOREIGN PATENT DOCUMENTS

| | | |
|---|---|---|
| JP | 2003-87007 | 3/2003 |
| JP | 2003-217421 | 7/2003 |
| JP | 2004-32768 | 1/2004 |
| JP | 2004-120929 | 4/2004 |
| JP | 2004-282150 | 10/2004 |
| WO | WO 03/038992 A1 | 5/2003 |

OTHER PUBLICATIONS

Patent Abstracts of Japan, JP 06-214169, Aug. 5, 1994.
U.S. Appl. No. 11/555,437, filed Nov. 1, 2006, Kawai, et al.

FIG. 5A CASE OF UNCHANGED LINE WIDTH
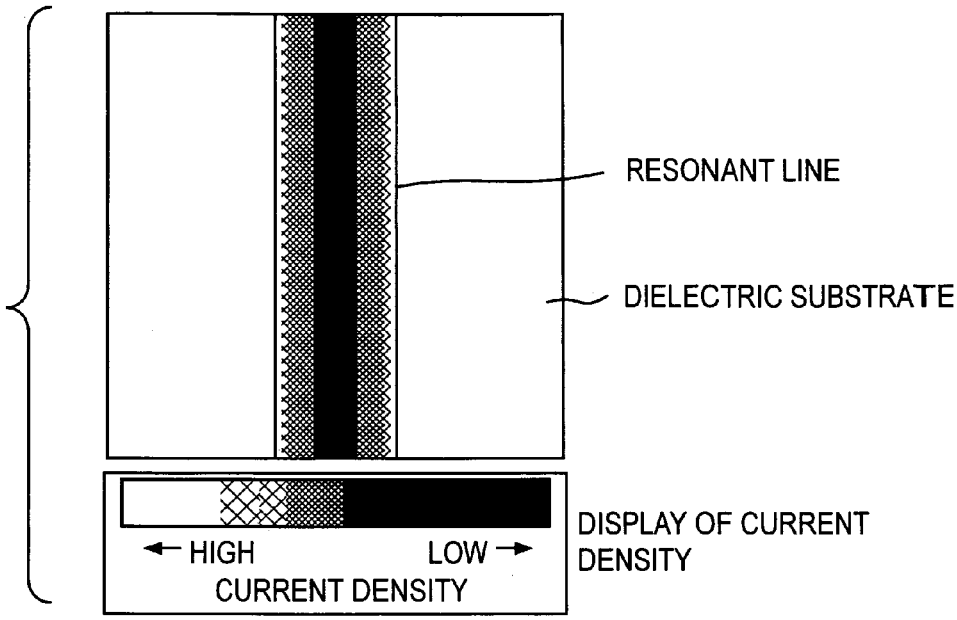
FIG. 5B CASE OF CHANGED LINE WIDTH
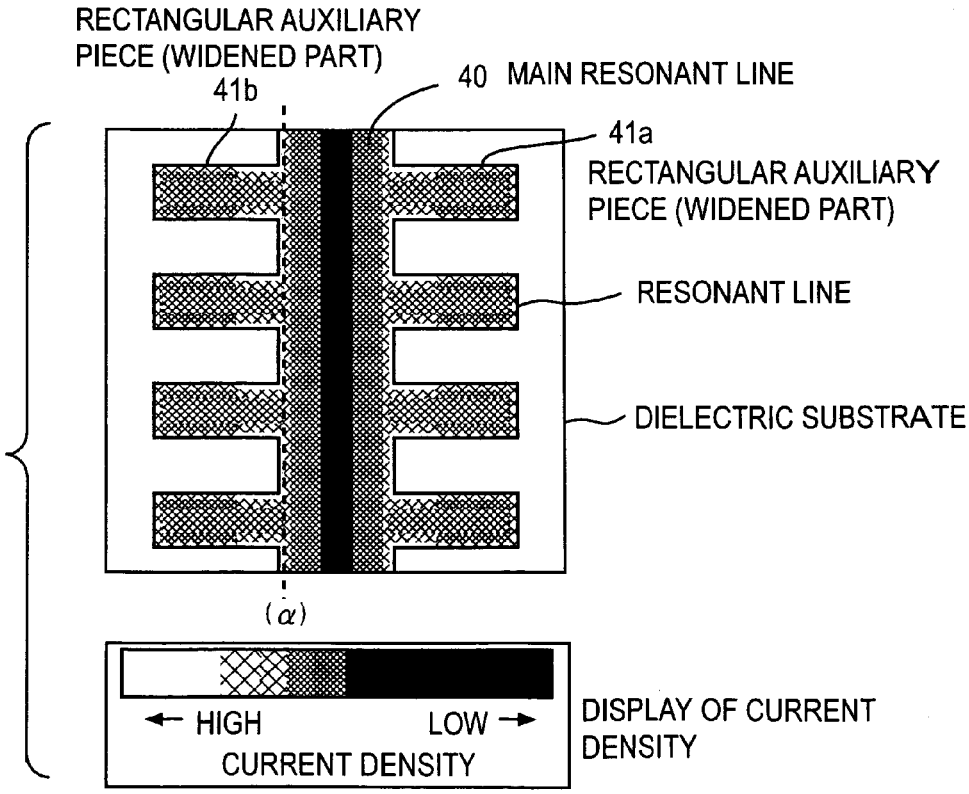

RESONATOR

BACKGROUND OF THE INVENTION

1. Field of the Invention

The present invention relates to a resonator mounted in a radio communication apparatus, which comprises a dielectric substrate and a line of a predetermined length that is formed on the dielectric substrate.

2. Description of the Related Art

In the field of radio communication using high frequency, a necessary signal and an unnecessary signal are classified by taking out a signal of specific frequency out of many signals. A circuit performing this function is generally referred to as a filter and is mounted in a number of radio communication apparatuses. A resonator constituting a filter and having a line structure needs a line length of a quarter of or a half of the wavelength of the resonance frequency. In such resonators, a center frequency and a bandwidth which are design parameters are mostly fixed. When a plurality of frequency bands are used in a radio communication apparatus using these resonators, there is a method in which a plurality of resonators respectively having a different center frequency and a different band width are provided, and a resonator to be used is selected by switching a switch and the like.

It is also a considered method to combine a variable capacitive element with an inductance element having a line structure for obtaining a desired resonant frequency, instead of using the plurality of resonators. As an example of the method, contents described in paragraph 0004 and FIG. 2 of Japanese Patent Application Laid Open No. 6-61092 (hereinafter referred to as "document 1") is shown in FIG. 1. An input strip line 273 provided with an input terminal 272 formed on an insulator 271 on a ground substrate 270 is connected to a movable electrode 277 formed on a displacement surface 276 of mechanical displacing means 275. The mechanical displacing means 275 is held by a structure body 278 for fixing it. Parts of the ground substrate 270 facing the movable electrode 277 projects from other parts, and an electrode 279 is formed on the surface of the projecting ground substrate 270, so that the movable electrode 277 and the electrodes 279 constitute a variable capacitive element. The movable electrode 277 is connected to a strip line 281 serving as an inductive reactance, which is formed on an insulator 280 on the ground substrate 270, and of which end is grounded. A gap d is changed by changing the position of the movable electrode 277, so as to make a capacitive reactance of the variable capacitive element form between the movable electrode 277 and the electrode 279 changed, as a result of which the resonance frequency is changed.

Besides the above described method, there is also an example described in the paragraph 0018, FIG. 2 of Japanese Patent Application Laid Open No. 7-321509 (hereinafter referred to as "document 2"). There is also proposed a method in which capacitors are arranged outside the resonator, instead of using the mechanical displacing means, and the resonance frequency is changed by selectively connecting the externally arranged capacitors.

In order to lower the resonance frequency of a resonator having a line structure, it is necessary to extend the line length. The line length needs to be doubled in order to halve the resonance frequency. Therefore, there is a problem that the resonator becomes large. For example, when the resonance frequency change from 4 GHz to 2 GHz, in the case of a quarter wavelength resonator, the line length needs to be doubled from 18.75 mm to 37.5 mm. This is an example in the case where the wavelength shortening effect of a dielectric substrate is not considered, but even when the effect is taken into consideration, the condition that the line length needs to be doubled in order to halve the resonance frequency, is not changed.

The conventional variable resonator of which resonance frequency can be changed, has also disadvantages that mass productivity is poor because the capacitive reactance component is changed by using the mechanical displacing means, and that reproducibility of the resonance frequency is low because the mechanical displacing means is liable to be affected by the ambient environment.

In the method in which capacitors are arranged outside a resonator having a line structure and selectively connected, small chip capacitors so-called 1005 having a width of 0.5 mm and a length of 1.0 mm are used as the capacitors. In the method, in addition to the size of the capacitor elements themselves, wirings for conducting signals are needed, as a result, the resonator becomes large. Further, the resonator has a common disadvantage that the resonance frequency is changed due to the deviation in mounting the chip capacitors and thereby reproducibility of the resonance frequency is poor.

SUMMARY OF THE INVENTION

The present invention has been made in view of the above described circumstances, and an object of the present invention is to provide a resonator capable of constituting a variable filter which has a small size, high mass productivity, low loss and high reproducibility of frequency.

The present invention provides a resonator comprising: a substrate formed with a dielectric or a semiconductor; an input/output line formed on the substrate, a signal being inputted from a terminal of one side of the input/output line, and being outputted from a terminal of the other side of the input/output line; a resonant line coupled to the input/output line and having a predetermined length; a counter electrode arranged opposite the resonant line with a space in the direction perpendicular to the substrate; and a grounded conductor part supporting the counter electrode, a capacitive reactance being formed between the resonant line and the counter electrode. Furthermore, the overlapped surface area between the resonant line and the counter electrode constituting the additional capacitive reactance, is created large if necessary, and further the counter electrode is provided for a part where the voltage amplitude of a standing wave generated on the resonant line is large.

BRIEF DESCRIPTION OF THE DRAWINGS

FIG. 5A is a figure showing current distribution of the microstrip line with a fixed line width;

FIG. 5B is a figure showing current distribution of the microstrip line with non-uniform the line width;

DETAILED DESCRIPTION OF THE PREFERRED EMBODIMENTS

In the following, preferred embodiments of the present invention will be described with reference to the accompanying drawings.

First Embodiment

Embodiment 1

Figure 1:
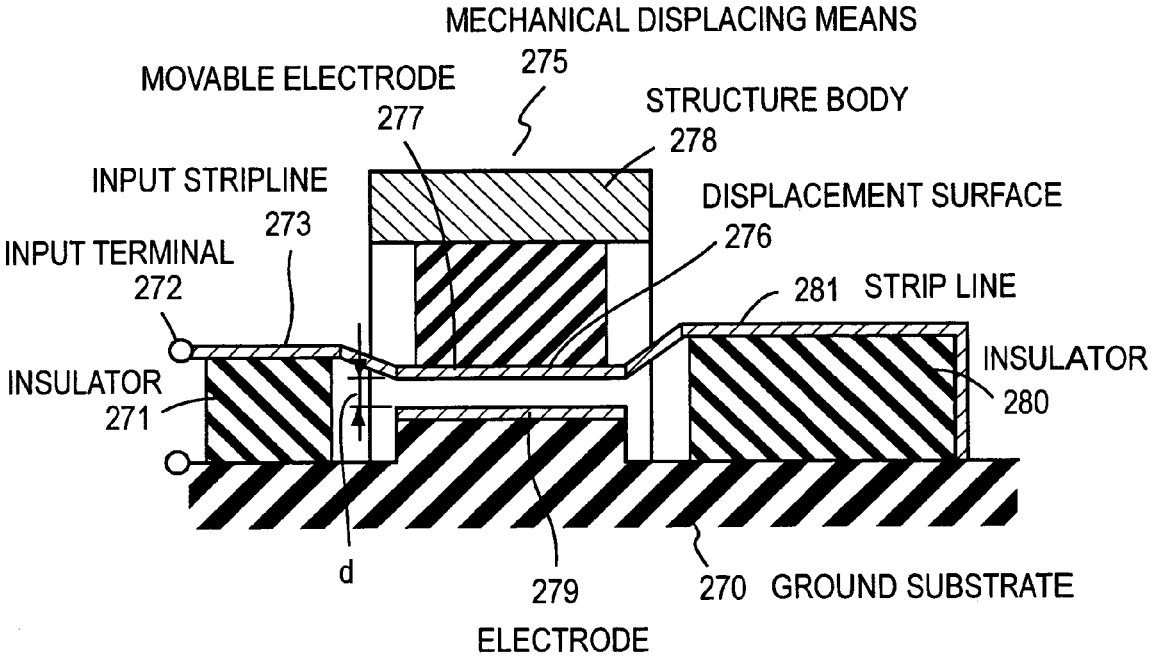
FIG. 1 PRIOR ART
FIG. 1 shows an example of a conventional variable resonator.
Figure 2:
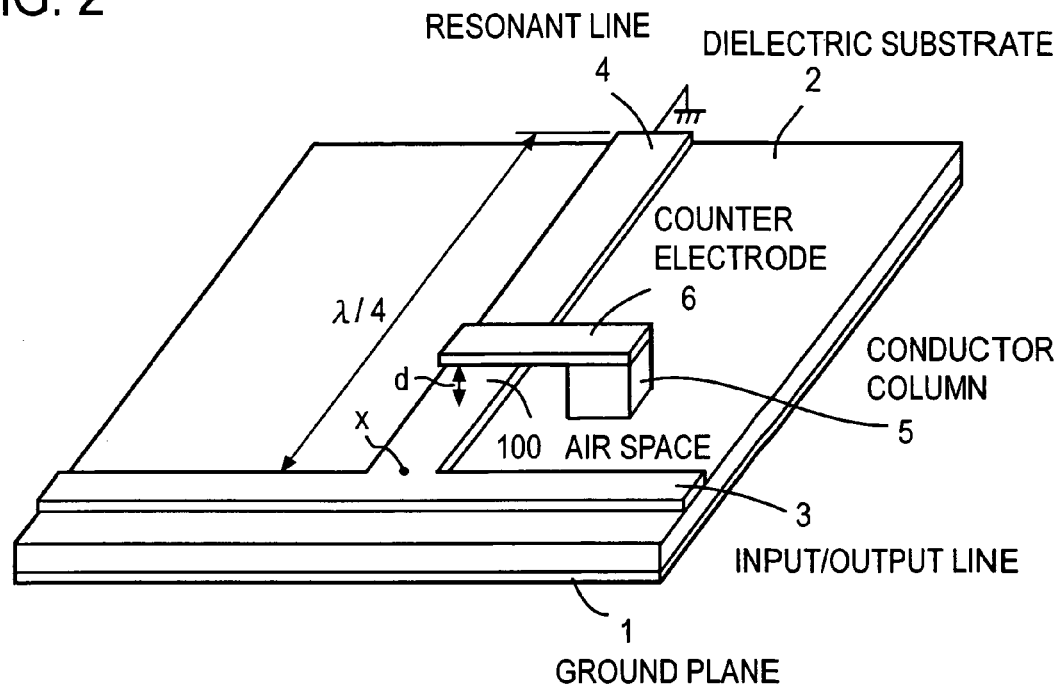
FIG. 2 shows a resonator of the present invention using a microstrip line.

FIG. 2 shows a resonator of the present invention using a microstrip line. An input/output line 3 is formed on the surface of a dielectric substrate 2, on which reverse side a ground plane 1 is formed. A high frequency signal is inputted from one end of the input/output line 3. A resonant line 4 having a length of about a quarter of the wavelength λ of the resonant frequency f is connected to nearly a center part of the input/output line 3, and formed on the dielectric substrate 2 in the direction perpendicular to the input/output line 3. The end of the resonant line 4 is electrically connected to the grounded ground plane 1. A counter electrode 6 facing a partial area of the resonant line 4 with an air gap 100 of a distance d in the direction perpendicular to the resonant line 4 is arranged. The counter electrode 6 is supported by a conductor column 5, and the conductor column 5 is connected to the ground plane 1 by a not shown Via hole (a conductor electrically connecting conductors on both sides of a substrate).

Generally, in a quarter wavelength resonator, when the length of the resonant line 4 is set to L, the resonance frequency f is expressed as follows:

$$f = \frac{\frac{c}{\sqrt{\varepsilon_{re}}}}{4L} \tag{1}$$

where c is the velocity of light in vacuum, and $\in_{re}$ which represents an effective relative dielectric constant, is mainly defined by a dielectric constant of the dielectric substrate 2, a substrate thickness of the dielectric substrate 2, and a line width of the resonant line 4.

Figure 3:
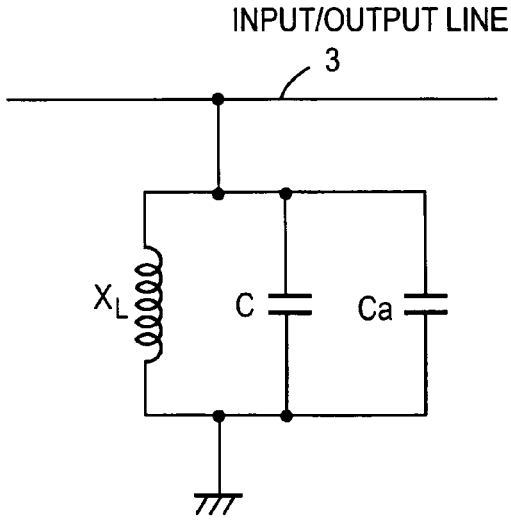
FIG. 3 shows an equivalent circuit of the resonator of the present invention.

At a resonance frequency f, the impedance Z viewed in the direction from a point X which is an intersection between the input/output line 3 and the resonant line 4, and which is a starting point of the resonant line 4, to the end of the resonant line 4, becomes almost infinite. As a result, when viewed from the starting point X, the resonant line 4 is virtually non-existent for the signal of the resonance frequency f. That is, only the frequency signal of the resonance frequency f which is a high frequency signal inputted into one end of the input/output line 3, is transmitted to the other end of the input/output line 3. In this embodiment, capacitive reactance Ca is formed by the partial area of the resonant line 4 and the counter electrode 6 facing the area, and the capacitive reactance Ca (formed by the resonant line 4 and the counter electrode 6) is added in parallel to a component of inductive reactance $X_L$ and a component of capacitive reactance C, which are determined by the shape of the resonant line 4. An equivalent circuit of this embodiment is shown in FIG. 3. That is, the capacitive reactance Ca formed between the counter electrode 6 and the partial area of the resonant line 4 is connected in parallel to the parallel resonant circuit of the inductive reactance $X_L$ and the capacitive reactance C which are determined by the dielectric constant of the dielectric and the length L of the resonant line 4. As a result, the resonance frequency f is decreased by the added capacitive reactance Ca (hereinafter abbreviated as "capacitance Ca"), as represented by the formula 2:

$$f = \frac{1}{2\pi\sqrt{X_L(C + Ca)}} \tag{2}$$

Figure 4:
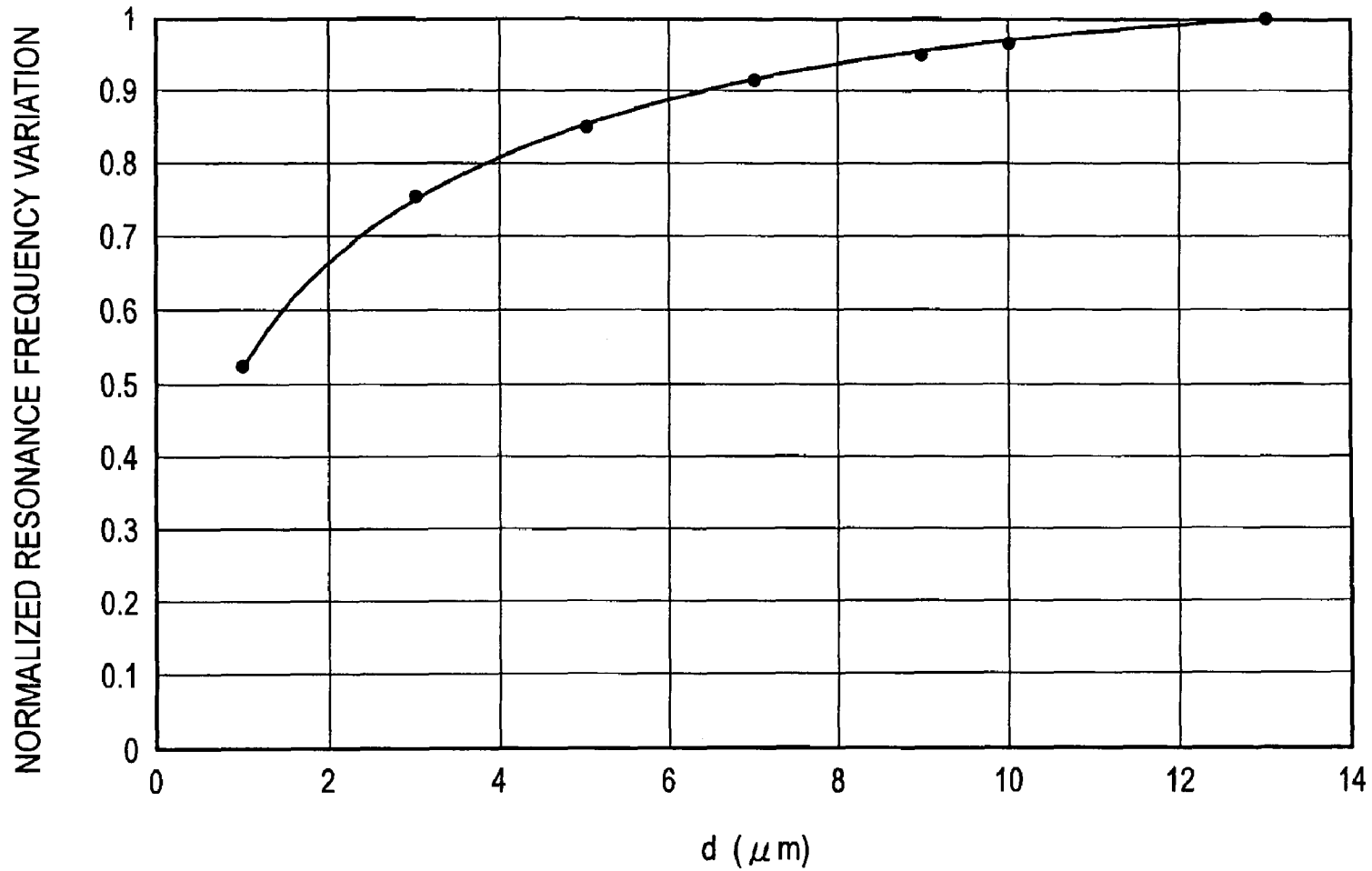
FIG. 4 is a figure showing a relationship between the electrode interval and the resonance frequency.

The value of the capacitance Ca is determined by a facing area of electrodes, an interval between electrodes, and a dielectric constant of dielectric provided between the electrodes, as in the case of a normal capacitor. Assuming that the facing area of electrodes forming the capacitance Ca of the resonator of the present embodiment shown in FIG. 2 is fixed to a certain value, an optimal electrode interval is examined. The result is shown in FIG. 4. The horizontal axis in FIG. 4 represents the interval d (μm) between the resonant line 4 and the counter electrode 6. The vertical axis represents the difference (change quantity) of the resonance frequency between the case where the counter electrode 6 is provided at the electrode interval d and the case where no counter electrode 6 is provided, by values normalized by the value when the electrode interval d is 13 μm. The dielectric between the resonant line 4 and the counter electrode 6 is air. In the vicinity of the electrode interval of d=13 μm, the inclination of the change quantity is small. That is, the resonance frequency is not changed. At the electrode interval d=10 μm, the resonance frequency is 97% of the resonance frequency and 95% at the electrode interval d=9 μm. The change quantity gradually becomes large, and the change quantity becomes 52% at the electrode interval d=1 μm. It can be seen from this result that the electrostatic coupling effect is obtained for the electrode interval d=10 μm or less, and the counter electrode 6 can be used for control of the resonance frequency.

In the case of attaching the capacitance Ca to the resonance line, a larger capacitance value can have a correspondingly increased effect on the resonance frequency, thereby enabling the size of the resonator to be reduced. It is a considerable method for increasing the capacitance Ca that the capacitance Ca is formed to be large by widening the width of the resonant line as well as by increasing the area of the counter electrode. As a method for widening the width of the resonant line, a method for simply widening the width of the line, and a method in which rectangular auxiliary pieces are added to both side edges of the resonant line, and protruded and recessed parts are formed at the side edge of the resonance line, so as to make the protruded parts form as electrodes, are conceivable. When the latter method is adopted, the geometrical length in the lengthwise direction of the resonant line can be collaterally shortened. This utilizes an effect that the current flowing part is concentrated on the outer edge part of the resonant line, as the frequency of an electric signal transmitted in the resonant line increases.

This effect is referred to as the skin effect and explained briefly below. When an electric signal is propagating in a conductor, the penetration depth of the signal in the width direction of the line, is referred to as the Skin Depth, and expressed by the formula 3.

$$\text{Skin Depth} = \frac{1}{\sqrt{\pi f\ \sigma\mu}} \tag{3}$$

where f is frequency, σ is a conductivity of the resonant line 4, and μ is a permeability of the resonant line 4.

FIG. 5A and FIG. 5B show the current density distribution of the microstrip line in the case where silver is used as a conductor of the line. In FIG. 5A and FIG. 5B, the input/output line through which a signal is outputted and inputted, and the end portion of the resonant line are not shown. The figures show only a part of the resonant line. FIG. 5A shows the case of a uniform line width, and it can be seen from the figure that the current concentrates on the edge part of the line. FIG. 5B shows the case where the line width is not uniform, that is, the case where rectangular auxiliary pieces 41*a* (hereinafter referred to as "widened part") are formed on the both side edges of the resonance line. These pairs of widened parts 41*a*, 41*b* are arranged along the main resonant line 40. That is, the resonant line including the widened parts corresponds to the case where resonant line width is changed in the lengthwise direction of the resonant line. In the case where the line width is changed in this way, a current less pass the shortest path (line α), and areas where the current density is high can be seen in the widened parts. This is because an electric signal does not penetrate into the line more deeply than the Skin Depth, but tends to flow in the outer part of the line. That is, the provision of the widened parts makes the current flow into the widened parts, thereby enabling the effective length of the resonance line to be increased. The substantial effective length in the example shown in FIG. 5B is considered to be larger than the shortest path α and less than the total length of the outer edge parts including the widened parts. Accordingly, the provision of the widened parts makes it possible to increase the substantial length of the resonance line, thereby enabling the size of the resonator to be reduced.

Embodiment 2

Figure 6:
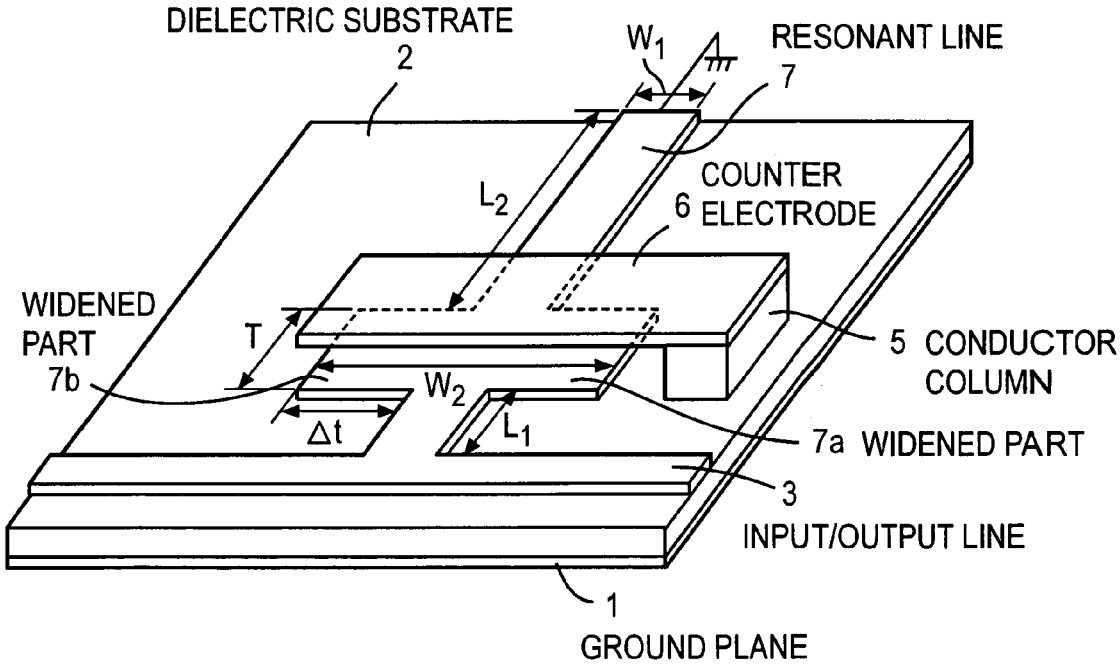
FIG. 6 shows a resonator using the skin effect, according to the present invention.

FIG. 6 shows an embodiment of the present invention, in which a further miniaturization is effected by increasing and decreasing the width of the resonance line in the lengthwise direction of the resonance line, that is, by forming recessions and projections at the side edges of the resonance line. The parts corresponding to those explained with reference to FIG. 2 are denoted by the same reference numbers, and the explanation of these parts is omitted. The shape of a resonant line 7 is different from that in FIG. 2. A high frequency signal is inputted from one end of the input/output line 3. The resonance line 7 having a same width $W_1$ as the input/output line 3 and a length $L_1$ is arranged approximately from the middle part of the input/output line 3 in the direction perpendicular to the input/output line 3. Both sides of a part with a length T extended from a position at a distance of $L_1$ from the input/output line 3, are provided with widened parts 7*a*, 7*b* in parallel with the input/output line 3, respectively. Thus, the width of the resonant line 7 is widened by +2Δt. On the side opposite the input/output line 3, a line having width $W_1$ is extended by the length $L_2$ in the direction perpendicular to the input/output line 3, and is grounded at its end by the ground plane 1. That is, the widened parts 7*a*, 7*b* of length T are formed on both sides in the midway of the resonant line of width $W_1$. The length $L_0$ of the outer edge parts of the resonant line of the embodiment of the present invention shown in FIG. 6 is given by $L_0=L_1+2\Delta t+T+L_2$. Here, the length of Δt and T need to be set longer than the skin depth. This is because the length shorter than the skin depth makes the current flow straight (line α in FIG. 5B), as explained in FIG. 5B. In the case where T is equal to a quarter of the wavelength λ of a signal, since the impedance is substantially changed by the widened portions, the signal reflects within the resonator, so that the resonator as a whole can not be effectively used. For this reason, the length of Δt and T are preferably greater than the skin depth and shorter than λ/4.

The effective length $L_R$ of the resonant line of the embodiment shown in FIG. 6 is considered to be between the straight line length $L_s=L_1+T+L_2$ and the length $L_0$ of the outer edge parts. That is, a relationship: $L_s<L_R<L_0$ is established. The effective resonant line length $L_R$ is obtained by a computer simulation or an experiment.

In this way, the length of the resonance line 7 in the direction perpendicular to the input/output line 3 on the dielectric substrate 2 can be reduced by means of Δt and T. The area can also be easily increased by making the widened parts 7*a*, 7*b* face the counter electrode 6. Accordingly, the value of the capacitance Ca formed between the counter electrode 6 and the resonant line 7 can also be increased. Thus, the provision of the widened parts for the resonant line 7, makes it possible to reduce the length of the resonant line 7 in the lengthwise direction, and to increase the value of the capacitance Ca which is add. This enables the resonator to be constituted in a smaller size.

Figure 7A:
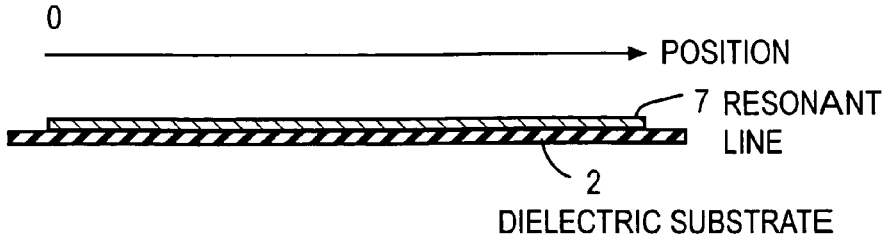
FIG. 7A is a side view of a dielectric substrate and a resonant line constituting the resonator.

Next, a voltage standing wave generated in the resonant line is explained. FIG. 7A to FIG. 7E show how the standing wave is generated in a resonant line, in the case where the length of the resonant line is set to a quarter or a half of the wavelength λ of the resonance frequency f, and the tip of the resonance line is short-circuited to be grounded, or opened. FIG. 7A is a side view of a dielectric substrate and the resonant line constituting the resonator. The resonant line 7 is formed on the dielectric substrate 2. The starting point of the resonant line 7 is set to 0 (the point X shown in FIG. 2). The end of the resonant line 7 is taken at a distance of λ/4 or λ/2 from the starting point, in accordance with the length of the resonance line 7, and is grounded or opened depending upon the structure of the resonator.

Figure 7B:
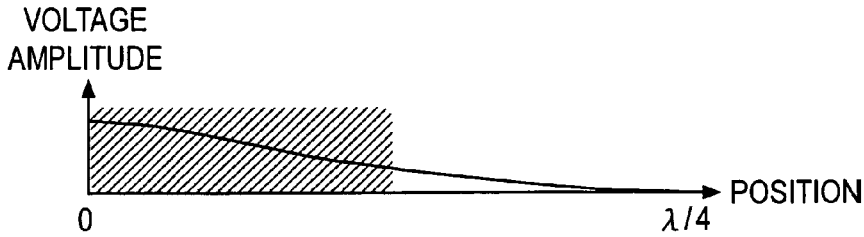
FIG. 7B is a figure showing a voltage standing wave generated in the resonant line, in the case where the resonant line has a line length of λ/4, and is short-circuited and grounded at a tip of the resonant line.

FIG. 7B shows a voltage distribution of a standing wave in the case where the line length is λ/4 and the tip of the line is short-circuited and grounded. The horizontal axis of FIG. 7B represents the position on the resonant line shown in FIG. 7A. Since the tip of the line with the line length of λ/4 is grounded, the amplitude of voltage is 0 at the tip, and the voltage increases from the tip toward the input side and becomes the highest at the input end of the resonant line. That is, a waveform having a quarter of the wavelength λ of the resonance frequency f is generated as a standing wave, of which voltage becomes the highest at the starting point. The region from a part at which the voltage becomes the highest, to a part at which the voltage amplitude becomes 0 is generally referred to as the antinode of a standing wave. The part at which the voltage amplitude is 0, is generally referred to as the node of a standing wave. In the present invention, the resonance frequency f is controlled by means of the capacitance Ca formed between the counter electrode 6 and the resonant line. Thus, even in the case where a same capacitance is additionally provided, the resonance frequency will change widely, in other words Ca works effectively, if the Ca is formed on the part of which voltage to ground differs largely along the resonant line.

The variation of the resonance frequency f is simulated about the case where the same capacitance constituted by the counter electrode and the resonant line is added to the position close to 0 and the position close to λ/8, on the resonant line on the horizontal axis in FIG. 7B. The variation of the resonance frequency f is about 17% at the point close to 0, and about 2% at the point close to λ/8. In this way, the effect of the capacitance Ca on the resonance frequency f is increased as the magnitude of voltage amplitude of the standing wave increases. The relationship between the standing wave and the frequency change quantity will be described in detail below. Accordingly, in the case of the quarter wavelength line with the tip short-circuited, it is effective to provide the counter electrode for a part at a distance of not smaller than λ/8 and not larger than λ/4 from the short-circuited end part of the line.

Showing the example in which the line length is set to λ/2 seems to contradict the purpose of miniaturization of the present invention. However, when the present invention is applied to the resonator with λ/2 line length, the size of the resonator can be reduced as compared with the conventional resonator. Thus, the resonator with λ/2 line length is also explained here.

Figure 7C:
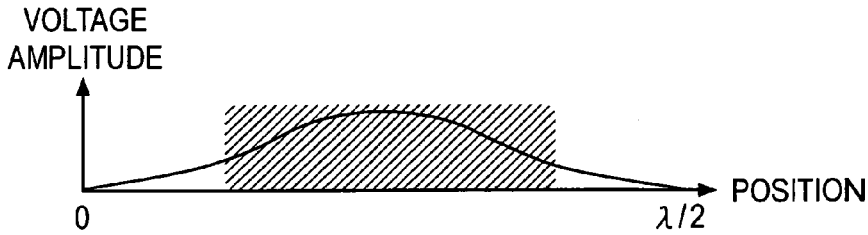
FIG. 7C is a figure showing a voltage standing wave generated in the resonant line, in the case where the resonant line has a line length of λ/2, and is short-circuited and grounded at a tip of the resonant line.

FIG. 7C shows a voltage standing wave generated in the resonant line of the half wavelength resonator, of which tip is short-circuited. Since the tip of the line is grounded, the amplitude at the tip is 0, and the voltage increases from the tip toward the input side and becomes the highest at λ/4 from the tip of the line. That is, a waveform with half the wavelength λ of the resonance frequency f, in which the voltage becomes the highest in the middle of the line, is generated as a standing wave. In this case, it is effective to provide the counter electrode for a part at a distance of not smaller than λ/8 and not larger than 3λ/8 from the tip of the line, the part in which the voltage amplitude is relatively large.

Figure 7D:
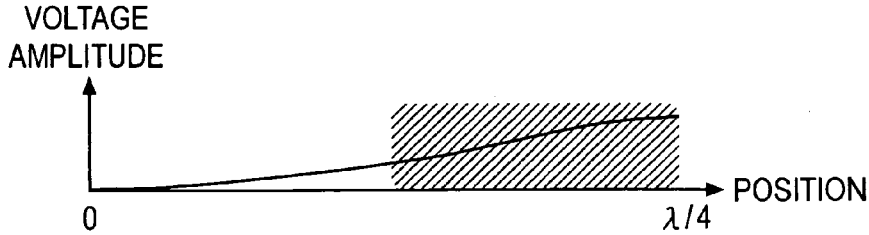
FIG. 7D is a figure showing a voltage standing wave generated in the resonant line, in the case where the resonant line has a line length of λ/4 and is opened at a tip of the resonant line.

FIG. 7D shows a voltage standing wave generated in the resonant line of the quarter wavelength resonator with the tip of the line opened. In this case, since the tip of the line is opened, the amplitude at the tip of the line is the highest, and the voltage decreases from the tip toward the input side. That is, a waveform with a quarter of the wavelength λ of the resonance frequency f, in which the voltage becomes the highest at the tip of the line, is generated as a standing wave. In this case, it is effective to provide the counter electrode for a part at a distance of not larger than λ/8 from the tip of the line, the part in which the voltage amplitude is relatively large.

Figure 7E:
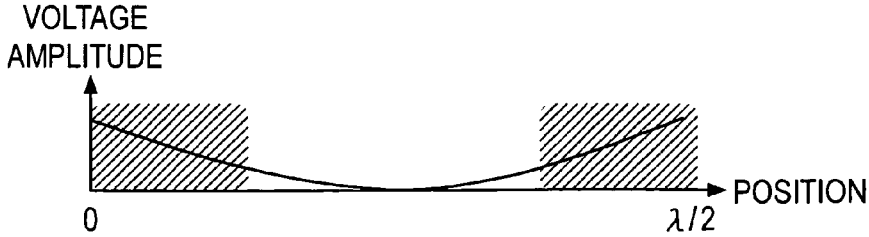
FIG. 7E is a figure showing a standing wave of voltage generated in the resonant line, in the case where the resonant line has a line length of λ/2 and is opened at a tip of the resonant line.

FIG. 7E shows a voltage standing wave generated in the resonant line of the half wavelength resonator with the tip of the line opened. Also in this case, since the tip of the line is opened, the amplitude at the tip of the line is the highest, and the voltage amplitude decreases from the tip to 0 at the center of the line, and increases again from the center of the line to the highest value at the starting point of the line. That is, a waveform with half the wavelength λ of the resonance frequency f, in which the voltage becomes the highest at the tip and the starting point of the line, is generated as a standing wave. In this case, it is effective to provide the counter electrode for a region at a distance of not larger than λ/8 from the tip of the line, and for a region at a distance of not larger than λ/8 from the starting point.

Embodiment 3

Figure 8:
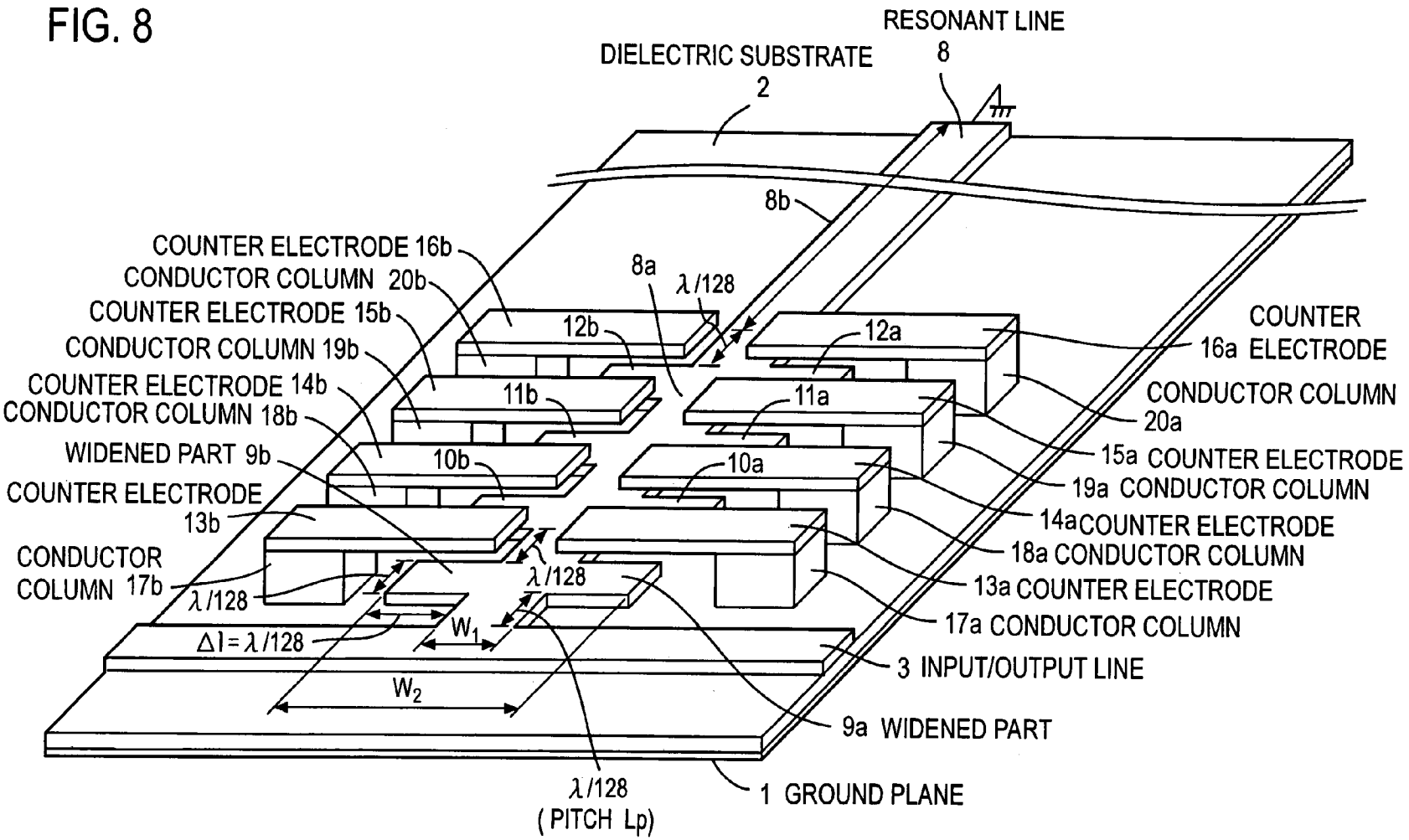
FIG. 8 shows an embodiment of a quarter wavelength line resonator with a tip grounded, in which the skin effect and the standing wave effect are taken into consideration.

FIG. 8 shows an embodiment of a quarter wavelength line resonator with the tip short-circuited, in the case where the standing wave effect is taken into consideration. In the present embodiment, components already explained are denoted by the same reference numerals, and the explanation of the components is omitted. Widened parts 9*a*, 9*b* are arranged with a same pitch $L_p$ at both side edges of a main resonant line 8 extended perpendicularly to the input/output line 3. For example, the pitch $L_p$ is set to λ/128, that is, the length of each of the widened parts 9*a*, 9*b* in the direction parallel to the input/output line 3 is set to λ/128. In addition, the length of each of the widened parts 9*a*, 9*b* in the direction perpendicular to the input/output line 3 is also set to λ/128. The widened parts 9*a*, 9*b* are repeatedly provided up to the position at a distance of λ/8 from the input/output line 3. That is, four widened parts are arranged. The pitch $L_p$ may not necessarily be the same, and the lengths of the widened parts 9*a*, 9*b* in the direction parallel and perpendicular to the input/output line 3 may also not necessarily be the same.

The resonant line 8*a* of λ/8-length provided with four widened parts is succeeded by a resonant line 8*b* integrated with the resonant line 8*a*, which is further extended with width $W_1$ so as to be grounded by connecting to the ground plane 1. The total effective line length of the resonant line 8*a* and the resonant line 8*b* is set to be λ/4. In FIG. 8, the length of the resonant line 8*b* is illustrated in a shortened form for reasons in drawing.

In the case of the present embodiment, there are provided four widened parts in the region at a distance of not larger than λ/8 from the input end (starting point), in which region the voltage amplitude is relatively large. The widened parts 9*a*, 9*b* are provided with counter electrodes 13*a*, 13*b*, with an air gap d in the vertical direction, respectively. The counter electrodes 13*a*, 13*b* are supported by conductor columns 17*a*, 17*b* connected to the ground plane 1 by Via holes (not shown). Similarly, widened parts 10*a*, 10*b* face counter electrodes 14*a*, 14*b*, which are supported by conductor columns 18*a*, 18*b*. Widened parts 11*a*, 11*b* face counter electrodes 15*a*, 15*b*, which are supported by conductor columns 19*a*, 19*b*. Widened parts 12*a*, 12*b* face counter electrodes 16*a*, 16*b*, which are supported by conductor columns 20*a*, 20*b*. Each pair of the widened parts and the counter electrodes forms the capacitance Ca, and influences the resonance frequency f. In the present embodiment, such provision of the counter electrodes for the widened parts makes it possible to increase the capacitance Ca formed between the resonance line 8 and the counter electrodes, and thereby to further reduce the size of the resonator having a low resonance frequency.

In the present embodiment, the counter electrodes 13*a*, 13*b* are arranged independently to face with each other from the right and left of the resonant line 8*a*, but the counter electrodes may be integrally formed so as to bridge over the widened parts of the resonant line 8*a*. In this case, a structure for supporting the counter electrodes by one conductor column may be adopted.

In the present embodiment, four counter electrodes are provided for convenience of explanation, but the counter electrode needs not be divided into four. It has no problem that the counter electrode may be formed in one large piece.

Second Embodiment

Next, embodiments in which the present invention is applied to a variable resonator, are described in order to further explain the present invention.

Embodiment 4

Figure 9:
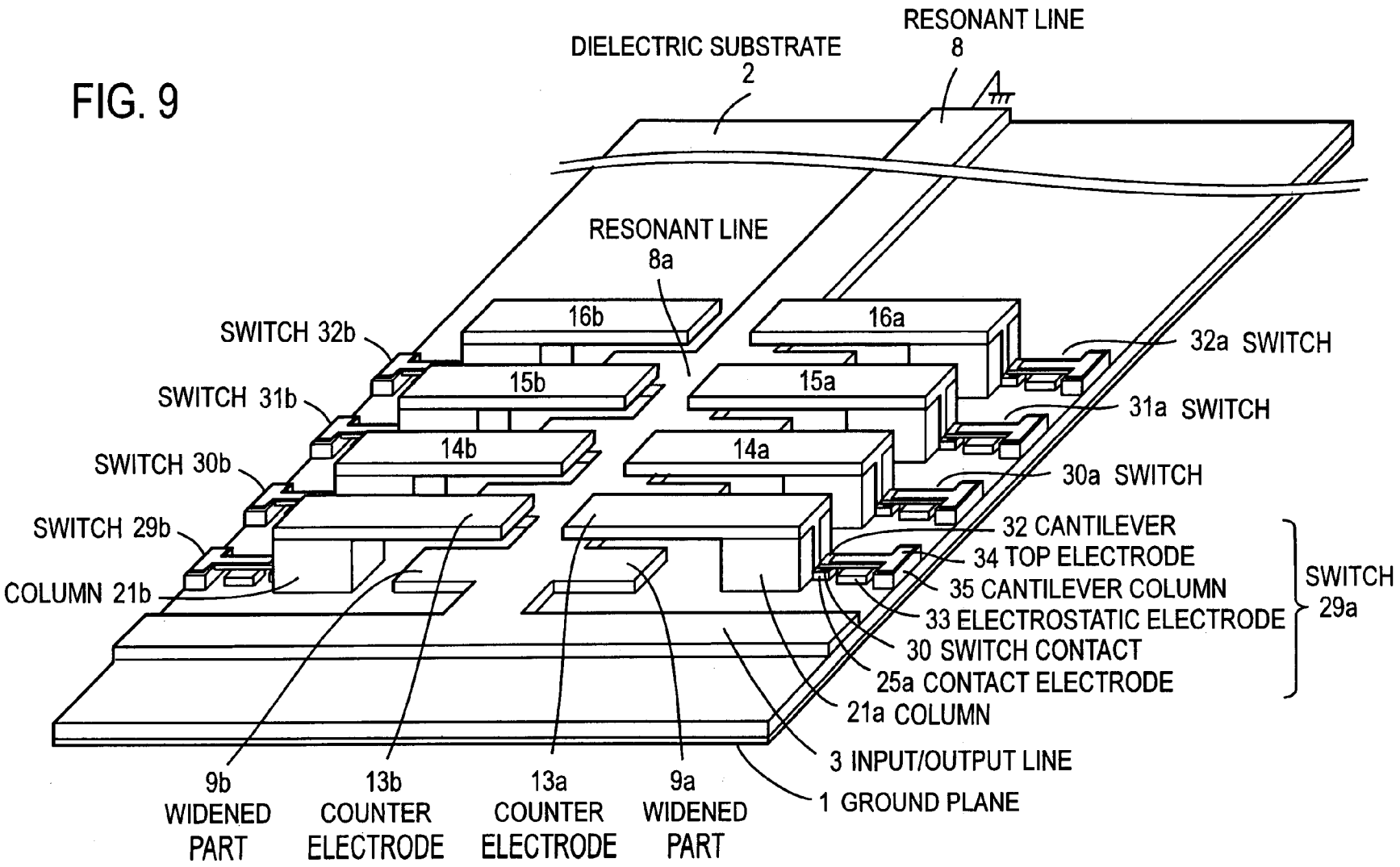
FIG. 9 shows an embodiment of a variable resonator formed by the resonator of the present invention explained in FIG. 8.

FIG. 9 shows an embodiment of the variable resonator of the present invention formed with the resonator explained in FIG. 8. The same components as those in FIG. 8 are denoted by the same reference numerals, and the explanation of the components is omitted. In the variable resonator in FIG. 9, each counter electrode is not directly grounded by the ground plane, but is grounded via a switch. There are provided switches 29*a* and 29*b* for grounding contact electrodes 25*a* and 25*b* that are electrically conductive to the counter electrodes 13*a* and 13*b*, in order to selectively ground the counter electrodes 13*a* and 13*b* (hereinafter components present in the horizontally opposing positional relationship on both sides of the resonant line 8*a*, are denoted by identification characters a, b). That is, the counter electrodes 13*a*, 13*b* are not directly grounded by the conductor column, unlike the embodiments described above. The counter electrodes 13*a*, 13*b* are supported by non-conducting columns 21*a*, 21*b*, and the contact electrodes 25*a*, 25*b* are formed along the wall of the columns 21*a*, 21*b* so as to be extended up to on the dielectric substrate 2. Whether the counter electrodes 13*a*, 13*b* are disconnected or grounded are controlled by the switches 29*a*, 29*b* provided on the dielectric substrate 2. Similarly, the counter electrodes 14*a*, 14*b* are controlled by switches 30*a*, 30*b*, the counter electrodes 15*a*, 15*b* are controlled by switches 31*a*, 31*b*, and the counter electrodes 16*a*, 16*b* are controlled by switches 32*a*, 32*b*.

A specific example of the switch 29*a* is shown in FIG. 10A to FIG. 10E, and the operation of the switch 29*a* is explained. A mechanical switch to which a MEMS (Micro Electromechanical Systems) technique is applied, is used for the embodiment of the switch 29*a* shown in FIG. 10A to FIG. 10E. The MEMS switch is capable of performing mechanically nearly perfect ON/OFF operations, compared with a switch using the conventional semiconductor device having nonlinear characteristic, and hence has characteristics that the transmission loss can be small, and that the insulation resistance can also be high in the OFF state.

Figure 10A:
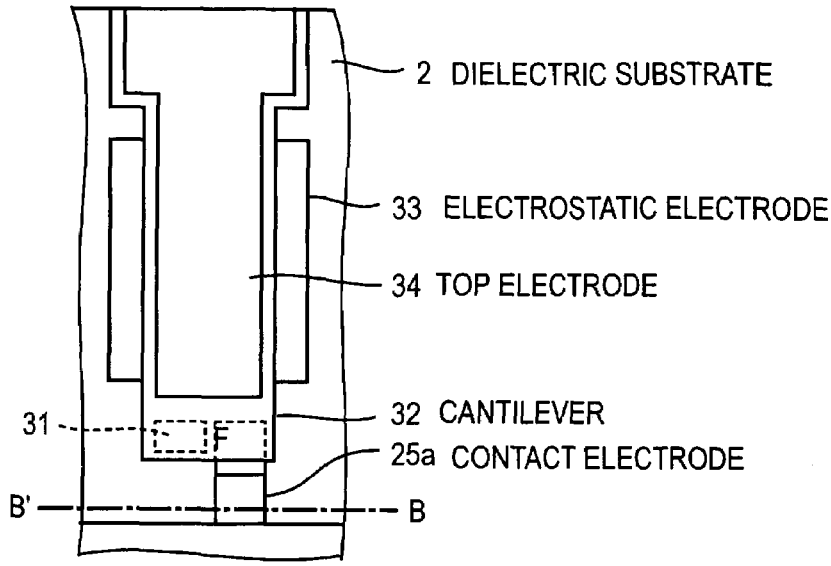
FIG. 10A is a top view showing an embodiment of a switch.
Figure 10B:
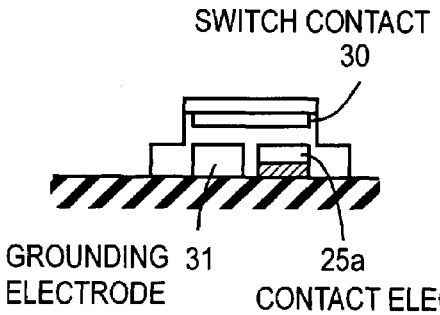
FIG. 10B is a front view from a cut surface obtained by cutting along line B-B' in FIG. 10A in the opened state.
Figure 10C:
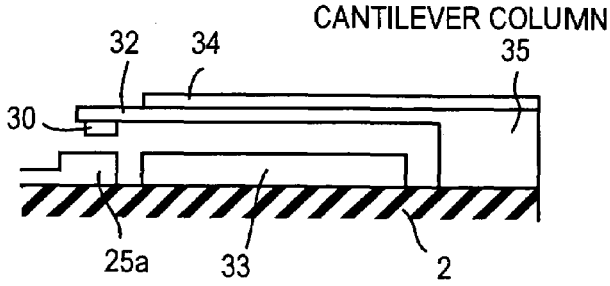
FIG. 10C is a side view of the switch in FIG. 10A in the opened state.

FIG. 10A to FIG. 10E represents a part cut out of the switch 29*a* for switching the counter electrode 13*a* of the embodiment of the variable resonator explained in FIG. 9. FIG. 10A is a top view, FIG. 10B is a front view seen from the cut surface along line B-B' in FIG. 10A, and FIG. 10C is a side view.

The switch shown in FIG. 10A to FIG. 10E is referred to as a cantilever type switch, in which a strip-shaped cantilever 32 with a small thickness, extended from a cantilever column 35 formed integrally with the dielectric substrate 2, serves as a moving part of the switch. The cantilever 32 is made by a manufacturing process using a semiconductor process, and is made of a silicon dioxide and the like. On the top surface of the cantilever 32, a top surface electrode 34 facing an electrostatic electrode 33 formed on the dielectric substrate is formed. A switch contact 30 is formed at the tip of the cantilever 32 on the side of the electrostatic electrode 33. Immediately below the switch contact 30, a contact of the contact electrode 25*a* electrically connected to the counter electrode, and a grounding electrode 31 connected to the ground plane by a Via hole (not shown) are arranged. When a voltage is not applied to the top surface electrode 34, the cantilever 32 maintains a horizontal state with respect to the dielectric substrate 2 by means of the elastic property of the cantilever 32 itself. This situation is shown in FIG. 10C. As shown in FIG. 10C, an air gap exists between the switch contact 30 and the contact electrode 25*a*, and the contact electrode 25*a* is electrically opened. Accordingly, the counter electrode connected to the contact electrode 25*a* is in the electrically opened state.

Figure 10D:
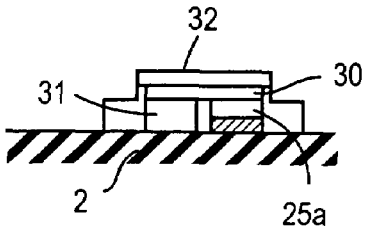
FIG. 10D is the front view from the cut surface obtained by cutting along line B-B' in FIG. 10A in the closed state.
Figure 10E:
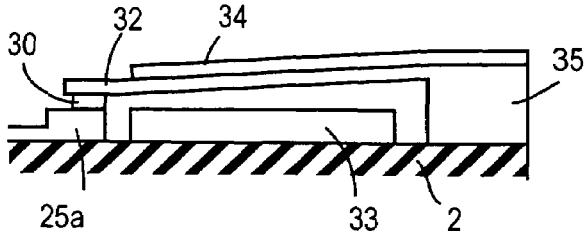
FIG. 10E is a side view of the switch in FIG. 10A in the closed state.

When a voltage is applied between the top surface electrode 34 and ground, Coulomb force is generated between the top surface electrode 34 and the electrostatic electrode 33 connected to the ground plane by the Via hole (not shown), making the cantilever 32 deflected to the side of the dielectric substrate 2. When the cantilever 32 is deflected by Coulomb force, the switch contact 30 comes into contact with the grounding electrode 31 and the contact electrode 25*a*. FIG. 10D shows a situation seen from the front of the cantilever 32 in the contact state. Similarly, FIG. 10E shows a situation seen from the side of the cantilever 32 in the contact state. From FIG. 10D and FIG. 10E, it can be seen the situation that the contact electrode 25*a* and the grounding electrode 31 are made to be electrically conducting so that the counter electrode is grounded. Thus, whether the counter electrode is grounded or opened can be controlled by applying or not-applying the voltage to the top surface electrode 34.

By the above described operation, the counter electrodes 13*a*, 13*b* are controlled by the switches 29*a*, 29*b*, the counter electrodes 14*a*, 14*b* are controlled by the switches 30*a*, 30*b*, the counter electrodes 15*a*, 15*b* are controlled by the switches 31*a*, 31*b*, and the counter electrodes 16*a*, 16*b* are controlled by the switches 32*a*, 32*b*, in order that each of the switches can be grounded or opened, respectively.

In the present embodiment, switches utilizing the MEMS technique are used, but the present invention is not limited to the embodiment. For example, the potential of the contact electrode can be similarly controlled by a PIN diode or a FET switch.

Embodiment 5

Figure 11:
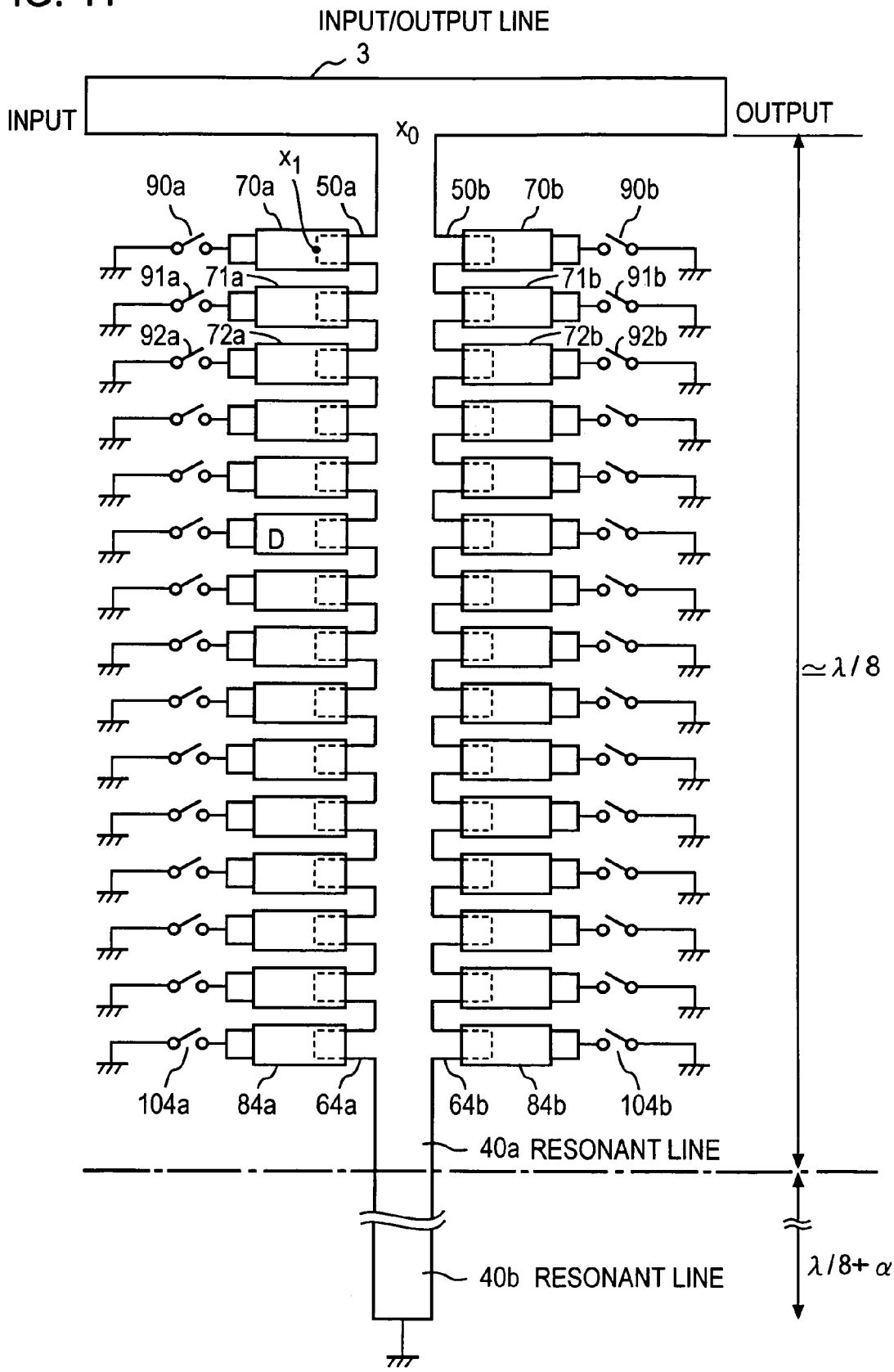
FIG. 11 shows a more specific embodiment of a variable resonator of the present invention.

Next, a more specific embodiment of a variable resonator is shown in order to explain the present invention. FIG. 11 is a quarter wavelength resonator of which tip is short-circuited, and a part of which is represented like an electric circuit. The resonant line of λ/4 is constituted by a resonant line 40*a* provided with the widened parts and the counter electrodes and a resonant line 40*b* without the widened parts and the counter electrodes. The line length of the λ/8 resonant line 40*a* provided on the side of starting point $X_0$ of the resonant line is equally divided by 16, and the widened parts are provided for the 15 parts of the resonant lines 40*a* equally divided by 16, from the starting point of the resonant line. That is, at the position at a distance $X_1$ (λ/128) from the starting point $X_0$ of the resonant line, there are arranged widened parts 50*a*, 50*b*, counter electrodes 70*a*, 70*b* which face the widened parts, and switches 90*a*, 90*b* which control the potential of the counter electrodes. The parts shown by broken lines of the widened parts 50*a*, 50*b* are areas facing the counter electrodes 70*a*, 70*b*. At the position at a distance of $2X_1$ (2λ/128), widened parts 51*a*, 51*b*, counter electrodes 71*a*, 71*b*, and switches 91*a*, 91*b* are arranged. Hereinafter similarly, there are arranged fifteen sets of the widened parts, counter electrodes and switches, up to widened parts 64*a*, 64*b*, counter electrodes 84*a*, 84*b*, and switches 104*a*, 104*b* which are arranged at the position at a distance of $15X_1$ (15λ/128). In the present embodiment, the area of each widened part of the resonant line facing the counter electrode is set to 100 $\mu m^2$ (portion of the widened part represented by broken line), and the interval between the resonant line and the counter electrode is set to 1 μm. The resonant line 40*b* has a line form without the widened part. In FIG. 11, the whole structure of the present embodiment can not be illustrated in the same dimensions, and hence is illustrated by shortening the length of the resonant line 40*b*.

Figure 12A:
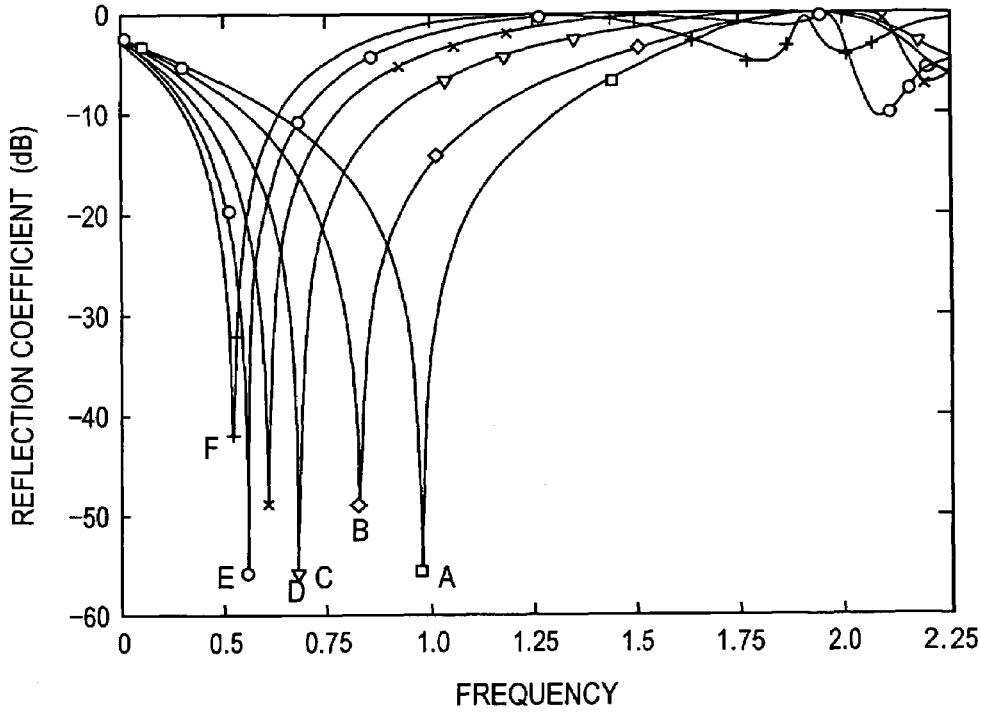
FIG. 12A is a figure showing reflection coefficients of the resonator shown in FIG. 11.
Figure 12B:
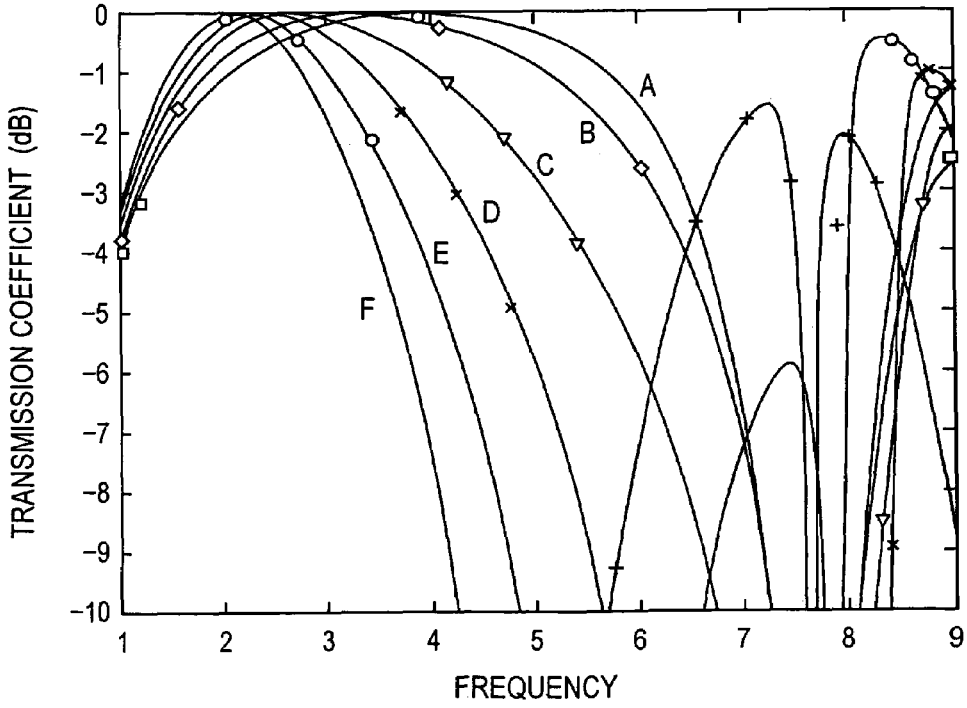
FIG. 12B is a figure showing transmission coefficients of the resonator shown in FIG. 11.

FIG. 12A and FIG. 12B show results of simulation of the resonance frequency of the resonator shown in FIG. 11. In FIG. 12A, the vertical axis represents the reflection coefficient (dB), and the horizontal axis represents the frequency normalized by the resonance frequency when all switches from the switches 90*a*, 90*b* to the switches 104*a*, 104*b* are opened. In FIG. 12A, a frequency with the smallest reflection coefficient is the resonance frequency. In FIG. 12B, the vertical axis represents the transmission coefficient (dB), and the horizontal axis represents the same normalized frequency as in FIG. 12A. "A" represents a characteristic in the state where 15 sets of switches from the switches 90*a*, 90*b* to the switches 104*a*, 104*b*, are all in the opened state. Next, when only the switches 90*a*, 90*b* are closed, the resonance frequency is changed to about 85%, as shown by the characteristics "B". Further, when the switches 91*a*, 91*b* and the switches 92*a*, 92*b* are closed, the resonance frequency is changed to about 71%, as shown by the characteristics "C". Further, when 7 sets of switches up to the switches 96*a*, 96*b* are closed, the resonance frequency is changed to about 63%, as shown by the characteristics "D".

In this way, the resonance frequency can be changed simply by controlling the switches. In the present invention, the capacitance Ca formed on the resonant line 40*a* in the vertical direction can be selectively inserted into the resonance circuit. As a result, the present invention makes possible to change the resonance frequency extremely accurately.

Figure 13:
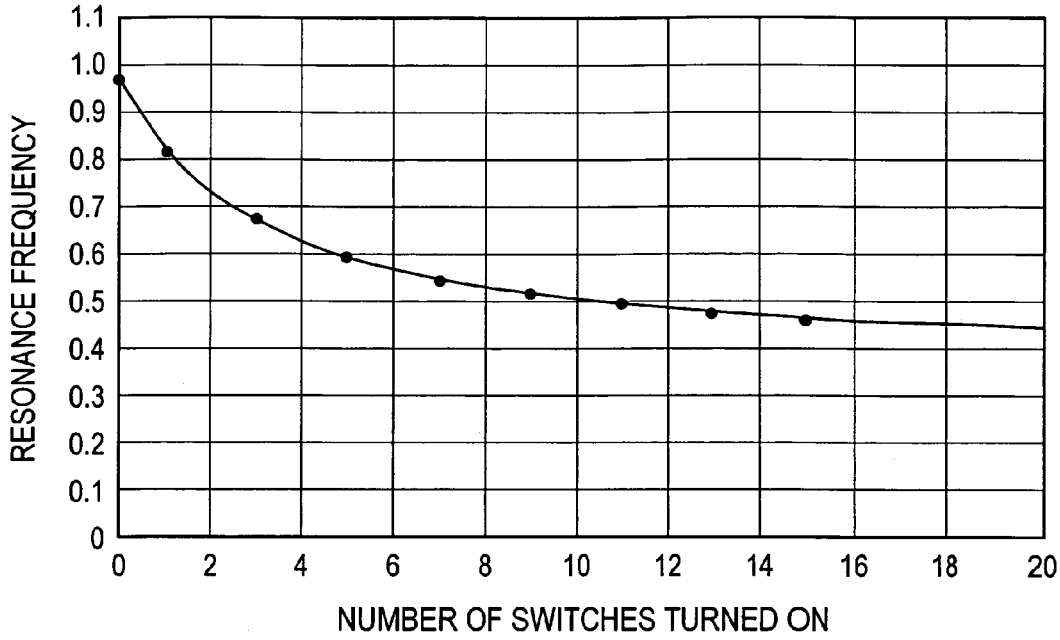
FIG. 13 is a figure showing a relationship between the number of switches turned on of the resonator shown in FIG. 11 and the resonance frequency.

FIG. 13 shows a variation of the resonance frequency when the 15 sets of switches from the switches 90*a*, 90*b* to the switches 104*a*, 104*b* are sequentially closed from the switches 90*a*, 90*b*. In FIG. 13, the vertical axis represents the value normalized by the resonance frequency when all sets of the switches from switches 90*a*, 90*b* to switches 104*a*, 104*b* are in the opened state, and the horizontal axis represents the number of switches which are sequentially closed from the switches 90*a*, 90*b*. That is, the value 15 on the horizontal axis indicates the state where all sets of the switches from the switches 90*a*, 90*b* to the switches 104*a*, 104*b* are closed. As the number of switches sequentially closed increases, the resonance frequency decreases, while the change quantity of the resonance frequency is gradually reduced. In the present embodiment, when 11 sets of the switches, that is, from the switches 90*a*, 90*b* to the switches 102*a*, 102*b*, are closed, the resonance frequency is halved.

As described above, in the prior art, the length of the resonant line needs to be extended twice in order to halve the resonance frequency. However, in the present invention, the resonance frequency can be halved without changing the length of the resonant line 40.

In FIG. 11, the same capacitances are added in order, but a characteristic that the magnitude of the individual resonance frequency shift is gradually reduced as the capacitances are added, is shown. This characteristic results from the relationship with the standing wave generated on the resonant line 40*a*. In the case of the quarter wavelength resonator of which tip is short-circuited as in the present embodiment, the standing wave amplitude is relatively large in the range from the starting point $X_0$ of the resonant line up to the distance of ⅛ of the wavelength λ of the resonance frequency, as explained in FIG. 7B, so that the resonance frequency can be effectively changed by adding the capacitance Ca in this range. When the switch 90 present at the position (position of about λ/128) closest to the starting point $X_0$ of the resonant line where the standing wave amplitude is the largest, is closed, the resonance frequency can be decreased by about 15%. The same capacitance is formed by the widened part 64 and the counter electrode 84, and even when the switch 104 present at the most distant position (position of about 15λ/128) from the starting point $X_0$ of the resonant line, is closed, the resonance frequency is changed by only about 2%. From this result, it can be seen that even when the widened part and the counter electrode are arranged on the resonant line 40*b*, the resonance frequency can not be significantly changed. When the resonance frequency is desired to be effectively changed, the widened part and the counter electrode need to be arranged at the area where the standing wave amplitude on the resonant line is large.

On the contrary, in the case where the resonance frequency is desired to be finely adjusted, it is preferred that the widened part and the counter electrode are positively arranged on the tip side of the line 40*b*.

Also, there is a case where the resonance frequency is desired to be linearly changed depending on the application. In this case, values of the capacitance Ca are not made to be a fixed value as in the embodiment shown in FIG. 11, but the values of the capacitance Ca may be gradually changed so that the resonance frequency is changed at a constant variation. For example, in the case where the magnitude of the each resonance frequency change in response to operation of the switch in the resonator shown in FIG. 11 is desired to be made linear, the capacitance $Ca_2$ formed by the widened parts 51*a*, 51*b* and the counter electrodes 71*a*, 71*b* may be made larger than the capacitance $Ca_1$ formed by the widened parts 50*a*, 50*b* and the counter electrodes 70*a*, 70*b*. Although the extent to which the capacitance is to be increased is different depending upon the magnitude of the resonance frequency change, it is possible to calculate the extent of the change quantity by using existing methods, such as the electromagnetic field simulation. Also, as the method for changing the capacitance, not only the method for changing the area of the widened part and the counter electrode, but also a method for changing the interval of electrodes of the widened part and the counter electrode may be used. A method for selectively providing dielectric materials having different dielectric constants between the electrodes may also be considered. Although the case where the resonance frequency is desired to be linearly changed is described above, the present invention is not limited to this case. The provision of plural kinds of capacitances Ca formed by the widened parts and the counter electrodes so as to obtain desired resonance frequencies, makes it possible to cope with any requirement.

Figure 14:
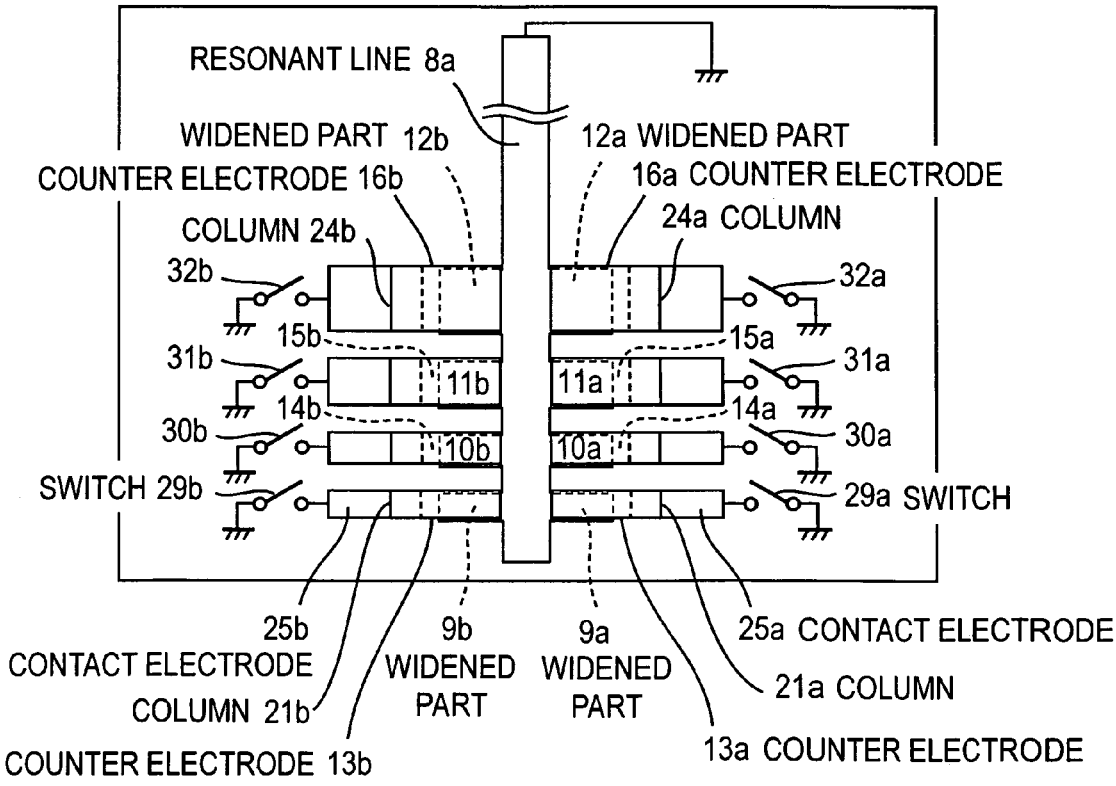
FIG. 14 shows an embodiment in which areas of the counter electrode and the widened part are changed.

An example of a method for changing the capacitance Ca is shown and explained. FIG. 14 shows an embodiment in the case where the area of the widened part and the counter electrode of the variable resonator of the present invention shown in FIG. 9, is gradually changed. In FIG. 14, the input/output line is omitted and the switches are drawn as circuit symbols. The same configurations are denoted by the same reference numbers and their explanation is omitted. FIG. 14 is different from FIG. 9 in that the area of the widened parts which are arranged from the widened parts 9*a*, 9*b* toward the line end, is gradually increased. That is, the area of widened parts 10*a*, 10*b* is larger than that of the widened parts 9*a*, 9*b* closest to the input/output line (not shown). The area of widened parts 11*a*, 11*b* is larger than that of the widened parts 10*a*, 10*b*, and the area of widened parts 12*a*, 12*b* becomes the largest. Each of the counter electrodes facing these widened parts are also gradually made larger, corresponding to the area of the widened part faced by the counter electrode. That is, the counter electrodes 14*a*, 14*b* have a larger area than the counter electrodes 13*a*, 13*b*. The counter electrodes 15*a*, 15*b* also have a larger area than the counter electrodes 14*a*, 14*b*. The electrodes 16*a*, 16*b* facing the widened parts 12*a*, 12*b* have the largest area. The capacitance Ca which is inserted into the resonant line 8 can be gradually increased toward the tip of the resonant line, by setting the shape of the widened parts and the counter electrodes in this way.

Figure 15A:
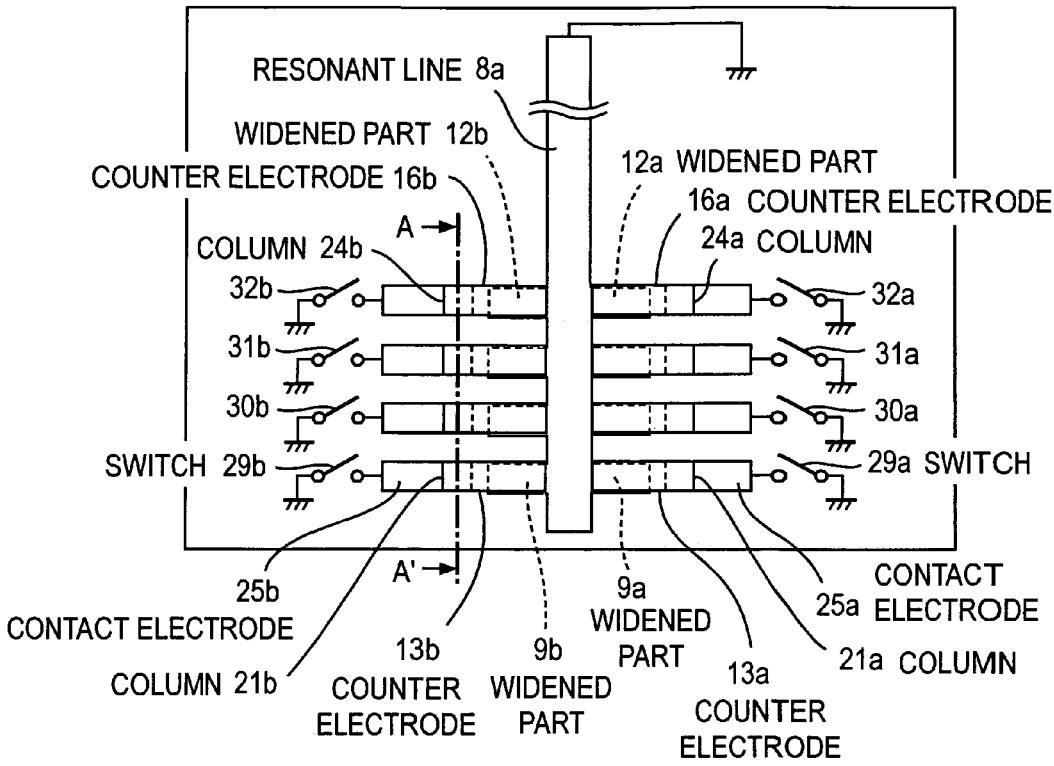
FIG. 15A shows an embodiment in which intervals between the counter electrode and the resonant line is changed.
Figure 15B:
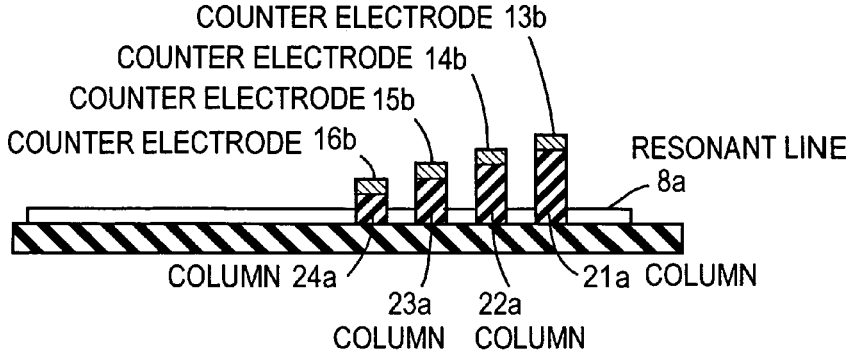
FIG. 15B is a sectional view in which the section along line A-A' in FIG. 15A is viewed in the right direction (the direction from the counter electrode 13*b* to the counter electrode 13*a*)

FIG. 15A also shows an embodiment in which the electrode interval between the widened part and the counter electrode is changed, as a method for setting to gradually increase the capacitance Ca toward the tip of the line. The same configurations are denoted by the same reference numbers and their explanation is omitted. FIG. 15A is different from FIG. 9 in that the electrode interval between the widened part and the counter electrode is gradually decreased in the direction toward the line end. FIG. 15B is a sectional view in which the section along line A-A' in FIG. 15A is viewed in the right direction (the direction from the counter electrode 13*b* to the counter electrode 13*a*). A column 22*b* supporting the counter electrode 14*b* is lower than the column 21*b* supporting the counter electrode 13*b*. The column 23*b* supporting the counter electrode 15*b* is also lower than the column 22*b*. The column 24*b* supporting the counter electrode 16*b* is lower than the column 23*b*, and is the lowest. In this way, even in the case where each area of the parts of the widened parts, overlapping with the counter electrodes overlap is the same, the capacitance Ca can be gradually increased toward the end of the resonant line 8, by gradually decreasing the height of each column.

As described above, the present embodiments make it possible to decrease the resonance frequency to a half value without increasing the length of the resonant line. In the present invention, since the counter electrodes are arranged in the height direction of the dielectric substrate on which the resonator is formed, it might be concerned that the size of the resonator in the height direction is increased as compared with the conventional resonator without such arrangement.

However, it is possible to realize a resonator with the same size in the height direction as compared with the conventional resonator. This is because in the counter electrodes structurally added according to the present invention, the interval between the counter electrodes and the resonant line, is 1 μm as described above, and can be formed within a range of several tens μm, even when estimated to be relatively large. On the other hand, the dielectric substrate on which the resonator is formed, is not used in the state as it was fabricated, and is normally enclosed in a metal case, as in the case of the conventional resonator. The interval between the metal case and the surface of the dielectric substrate on which the resonator is formed, is an order of mm, so that the size of structures of the counter electrodes and the like which are added according to the present invention, can be sufficient to be settled within the range of the interval.

Accordingly, the plane and volume size of the resonator and the variable resonator of the present invention can be half compared to the conventional resonator.

Since the counter electrodes and the other structures of the present invention can be essentially made by the same manufacturing process of semiconductor LSI, the capacitance Ca can be extremely accurately formed. Accordingly, the resonance frequency can be highly precisely adjusted, and in the case of the variable resonator, the resonance frequency can be changed with good reproducibility.

The above described embodiments are explained by using examples in which the input/output line and the resonant line are connected by a conductor with each other. However, the present invention is not limited to such embodiments. For example, in designing so as to provide flexibility in the coupling degree of the resonator, there are cases where the input/output line and the resonant line are magnetically (inductively) coupled with each other, or the case where the input/output line and the resonant line are coupled in an electric field (capacitively). These embodiments are shown and explained briefly.

Figure 16:
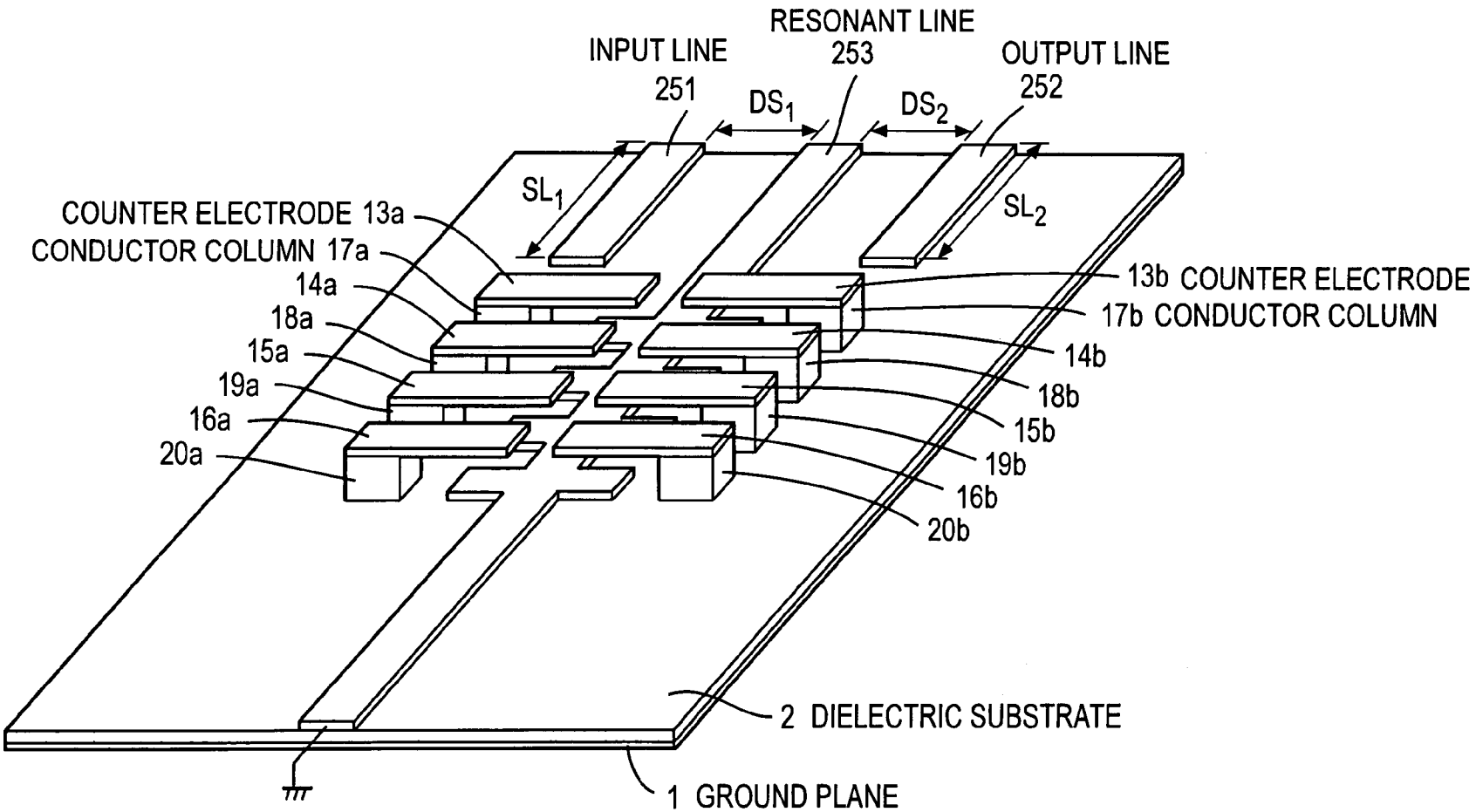
FIG. 16 shows an embodiment of a resonator of which input/output of signal is performed by magnetic coupling.

FIG. 16 shows an embodiment of a resonator in which the input and output are magnetically coupled. A resonant line 253 is arranged in parallel to and at an interval $DS_1$ with respect to an input line 251 having a fixed length $SL_1$ into which a high frequency signal is inputted. The resonant line 253 has for example, a line length of λ/4, the tip of which is short-circuited. The resonant line 253 is similarly provided with the counter electrodes and the widened parts as previously explained in FIG. 8, in a region beyond the part of the length $SL_1$ in parallel with the input line 251. The same components as those in FIG. 8 are denoted by the same reference numbers and their explanation is omitted. An output line 252 is arranged with an interval $DS_2$ from the resonant line 253 at a position across the resonant line 253 so as to face the input line 251. Thus, it is possible to constitute a resonator, even by arranging the input line 251, the resonant line 253 and the output line 252 separately from each other. In this case, the intensity of coupling between the input line 251 and the resonant line 253 can be arbitrarily set by the length $SL_1$ and the interval $DS_1$ that the input line 251 and the resonant line 253 face each other. The intensity of coupling on the output side can be set by the length $SL_2$ and the interval $DS_2$.

Figure 17:
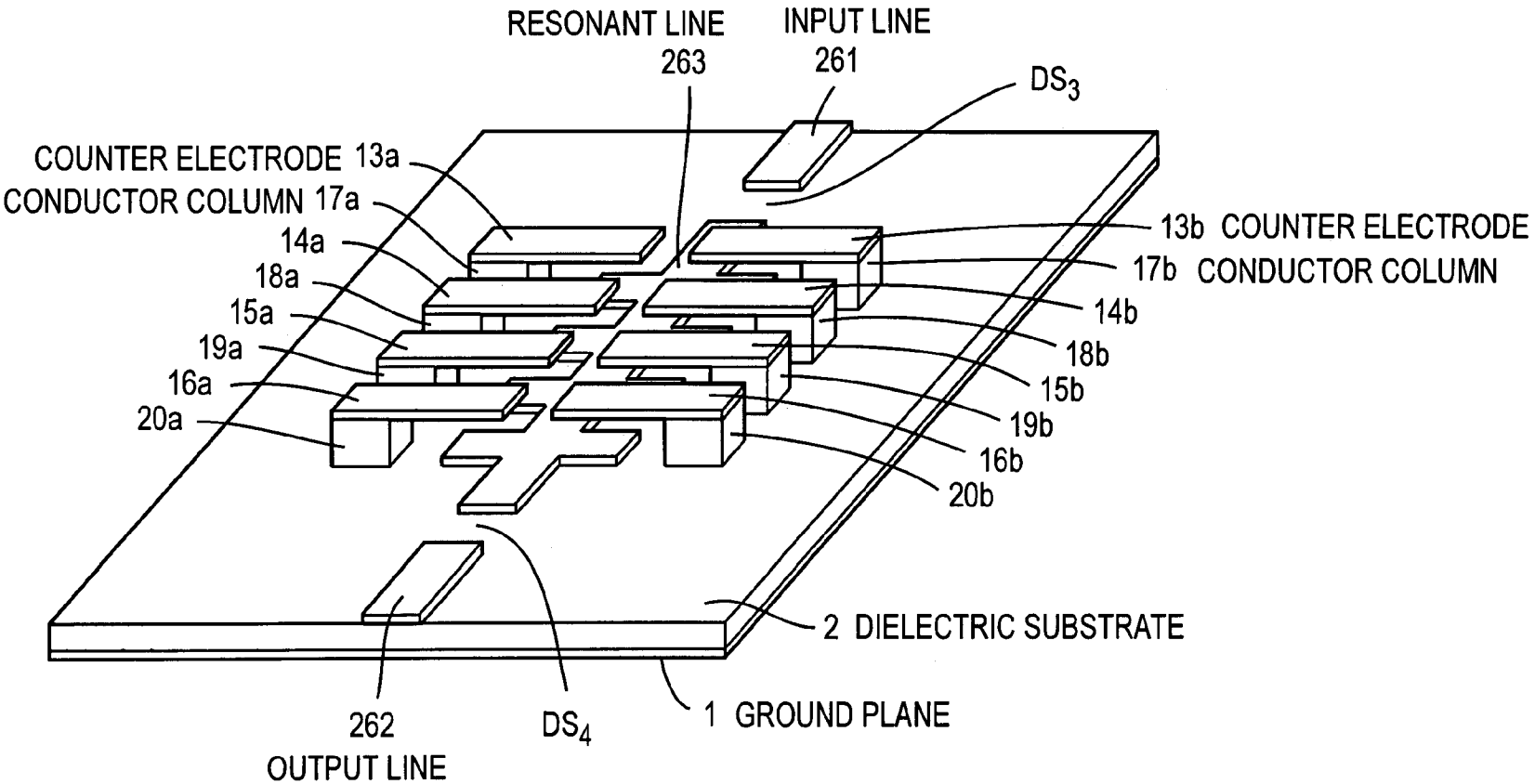
FIG. 17 shows an embodiment of a resonator of which input/output of signal is performed by electric field coupling.

FIG. 17 shows an embodiment of a resonator in which the input and output are connected by electric field coupling. A resonant line 263 with a certain width is arranged on an extension line of an input line 261 with a certain length and the same width, at an interval $DS_3$ from the input line 261. In the case of the present embodiment, the resonant line 263 has a certain length and is provided with the widened parts and the counter electrodes as those explained in FIG. 8. The same components as those in FIG. 8 are denoted by the same reference numbers and their explanation is omitted. An output line 262 having a certain length and the same width of the resonant line 263, is arranged on the side of the other end of the resonant line 263, with an interval $DS_4$ from the resonant line 263. In the above described form, it is also possible to constitute the resonator and the variable resonator of the present the invention. In this case, the intensity of electric coupling between the input line 261 and the resonant line 263 can be arbitrarily set by the size of the interval $DS_3$ and the width of the lines facing with each other. The output line can be similarly set by the size of the interval $DS_4$ and the width of the lines facing with each other.

EXAMPLES OF APPLICATION

Figure 18:
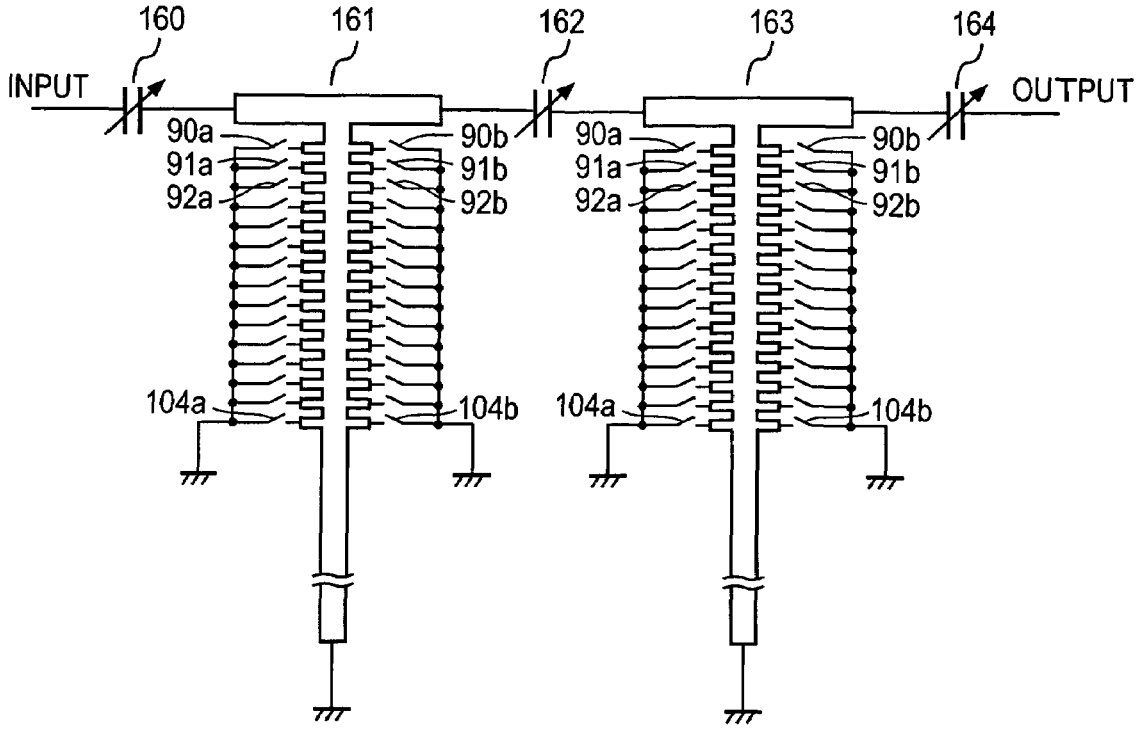
FIG. 18 shows an example in which a Butterworth filter is formed by the resonator shown in FIG. 11.

FIG. 18 shows an example in which a Butterworth filter is constituted by connecting the two variable resonators of the present invention in cascade via a coupling capacitance. The input signal is inputted into the first variable resonator 161 of the present invention via a coupling capacitive element 160. The output signal of the variable resonator 161 is inputted into a second variable resonator 163 via a coupling capacitive element 162. The output signal from the second variable resonator 163 is outputted via a coupling capacitive element 164. The first and second variable resonators 161, 163 have, for example, the same constitution as that of the variable resonator of the embodiment explained in FIG. 11 as it is. That is, the resonant line has a length of λ/4, and 15 sets of the widened parts, the counter electrodes and the switches are provided for the resonant line part of λ/8 on the side of the input/output line 3. The configuration of the variable resonator has already been explained and thus the explanation thereof is omitted.

Figure 19:
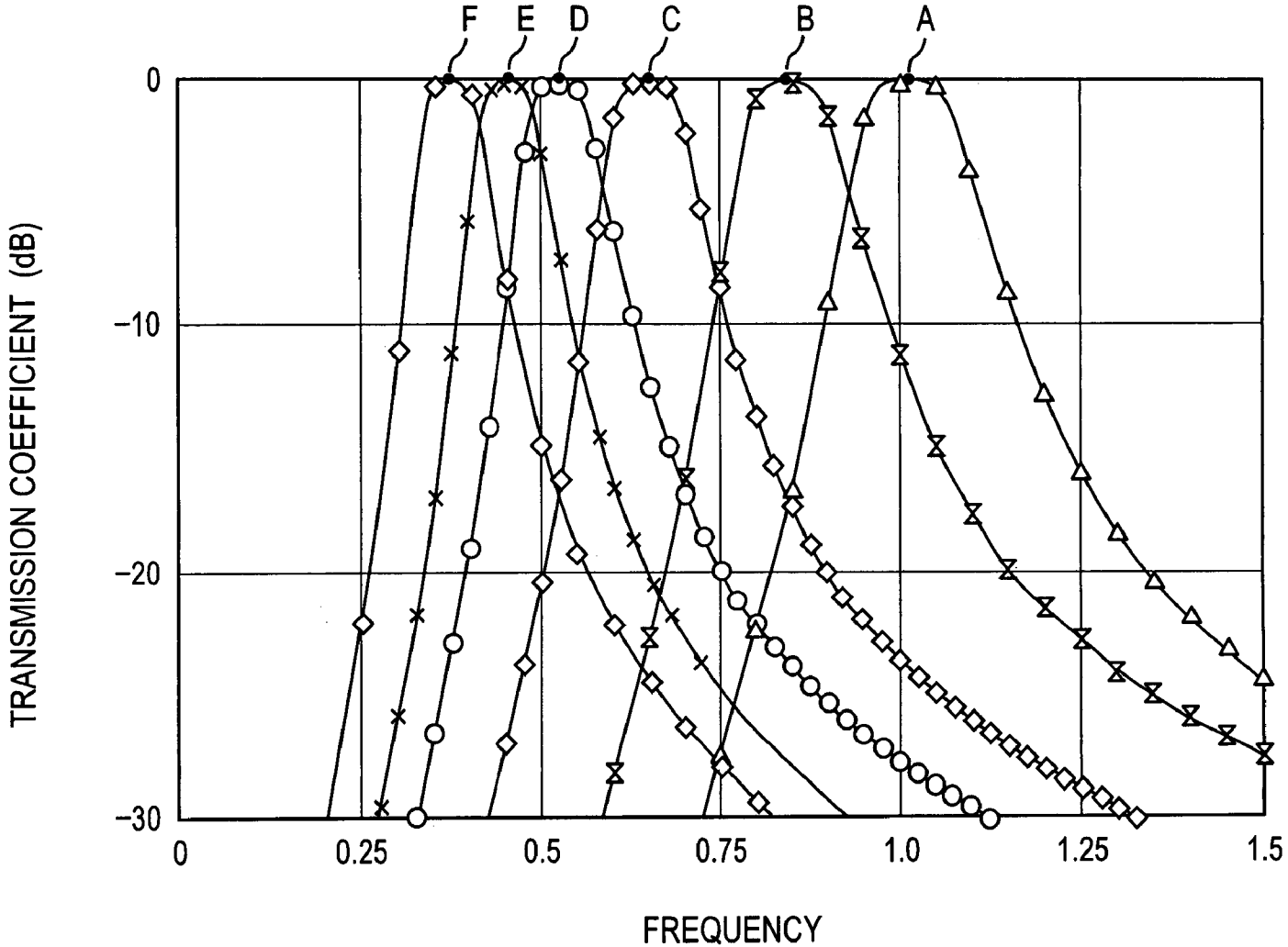
FIG. 19 is a figure showing transmission characteristics of the filter shown in FIG. 18.

FIG. 19 shows a frequency characteristic of the Butterworth filter shown in FIG. 18. The horizontal axis represents the frequency, of which values are normalized by a resonance frequency when 15 sets of the switches 90*a*, 90*b* to the switches 104*a*, 104*b* are all opened. The frequency characteristic shown in FIG. 19 is a result when switches of the first variable resonator 161 and the second variable resonator 163 are similarly operated. That is, when the switches 90*a*, 90*b* of the first variable resonator 161 are closed, the switches 90*a*, 90*b* of the second variable resonator 163 are also closed. The vertical axis represents the transmission coefficient (dB). The flat part in which the transmission coefficient is approximately 0 dB represents the pass band of the filter.

When the switches 90*a*, 90*b* are closed, the center frequency of the pass band is changed to about 83% (characteristic "B"). When three sets of the switches from the switches 90*a*, 90*b* to the switches 92*a*, 92*b* are closed, the center frequency of the pass band is changed to about 64% (characteristic "C"). When five sets of the switches from the switches 90*a*, 90*b* to the switches 94*a*, 94*b* are closed, the center frequency of the pass band is changed to about 51% (characteristic "D"). When ten sets of the switches from the switches 90*a*, 90*b* to the switches 99*a*, 99*b* are closed, the center frequency of the pass band is changed to about 36% (characteristic "F").

In this way, it is possible to simply constitute a highly precise variable filter by using the variable resonator of the present invention. In addition, a feature of the variable resonator of the present invention is a low insertion loss.

Figure 20:
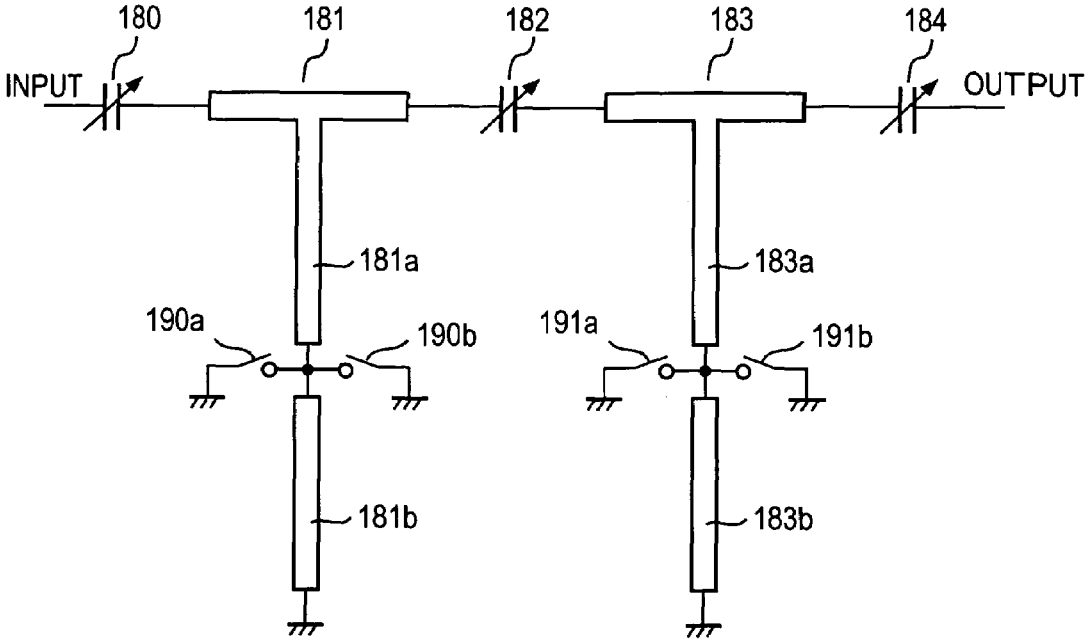
FIG. 20 shows an example in which a Butterworth filter is formed by the conventional resonator.

Next, the feature of low insertion loss is explained in relation to the result of comparison with the conventional resonator. FIG. 20 shows an example of 2-pole filter in which only conventional resonators are employed. This constitution is the same as the Butterworth filter shown in FIG. 18. An input signal is inputted into the first variable resonator 181 via a coupling capacitive element 180. The first variable resonator 181 which is a λ/4 wavelength resonator of which tip is short-circuited, is constituted by two resonant lines 181*a*, 181*b* of λ/8 wavelength for comparison with the variable resonator of the present invention, and the output end of the input side resonant line 181*a* is arranged to be grounded by switches 190*a*, 190*b*. Here, the reason for providing two switches 190*a*, 190*b* is to make the constitution meet the condition that two switches are closed when the resonant frequency is changed in the variable resonator of the present invention. The variable resonator of the present invention obviously works even if only one switch 190*a* is operated. The output signal of the first variable resonator 181 is inputted into a second variable resonator 183 via a coupling capacitive element 182. The output signal of the second variable resonator 183 is outputted via a coupling capacitive element 184. The constitution of the second variable resonator 183 is the same as that of the first variable resonator 181, and the explanation thereof is omitted.

Figure 21:
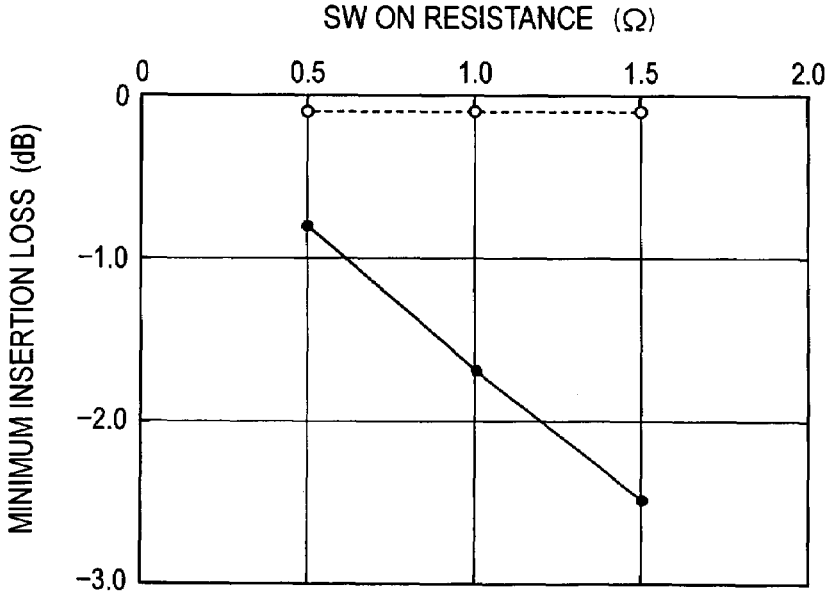
FIG. 21 is a figure showing a comparison of the maximum insertion loss of the Butterworth filters shown in FIG. 18 and FIG. 20.

FIG. 21 shows the result of simulation representing how the insertion loss of the filter constituted by the conventional resonator and the insertion loss of the filter according to the present invention are changed with respect to the change of ON resistance of the switch. The horizontal axis of FIG. 21 represents the ON resistance (Ω) of the switch. The vertical axis represents the minimum insertion loss (dB) at frequencies of the Butterworth filter shown in FIG. 18 and FIG. 20. Here, in the Butterworth filter constituted by the conventional resonator shown in FIG. 20, the length of the resonant line is halved by closing the switches 190*a*, 190*b* and switches 191*a*, 191*b*, so that resonance frequency is changed to be doubled. On the contrary, in the case of the Butterworth filter constituted by the resonator of the present invention shown in FIG. 18, the pass band frequency is changed to the lower side when the switches are closed. Thus, the minimum insertion loss is compared at different frequencies. Here, since the effect of the ON resistance of the switch inserted in the resonator upon the insertion loss is taken as an issue, the difference in frequency is not a problem in comparing the effect.

FIG. 21 shows the comparison result of the insertion loss of the filter constituted by the conventional resonator and the insertion loss of the filter according to the present invention, when the ON resistance of the switch is changed to 0.5Ω, 1.0Ω and 1.5Ω. The minimum insertion loss of the filter constituted by the conventional variable resonator is shown by the solid line in FIG. 21. A characteristic is shown, in which the insertion loss increases linearly with the increase of ON resistance of the switch. The minimum insertion loss of the filter constituted by the variable resonator of the present invention is shown by a broken line in FIG. 21. A flat characteristic within −0.1 dB is shown regardless of the variation of ON resistance of the switch. Thus, it can be seen that the insertion loss of the variable resonator of the present invention is almost unchanged for the ON resistance of this level. Comparison of the insertion losses of both the variable resonators at the ON resistance of 1.0Ω, shows that the insertion loss of the filter constituted by the variable resonator of the present invention is −0.1 dB (0.98), while the insertion loss of the filter constituted by the conventional resonator is −1.7 dB (0.68). That is, the insertion loss of the filter constituted by the variable resonator of the present invention is about 1/14 of the insertion loss of the filter constituted by the conventional variable resonator.

As described above, in the variable resonator of the present invention, the ON resistance of the switches inserted to make the frequency variable, does not directly affect the resonant line, as a result of which a resonator with a low loss can be realized.

Embodiment 6

Figure 22:
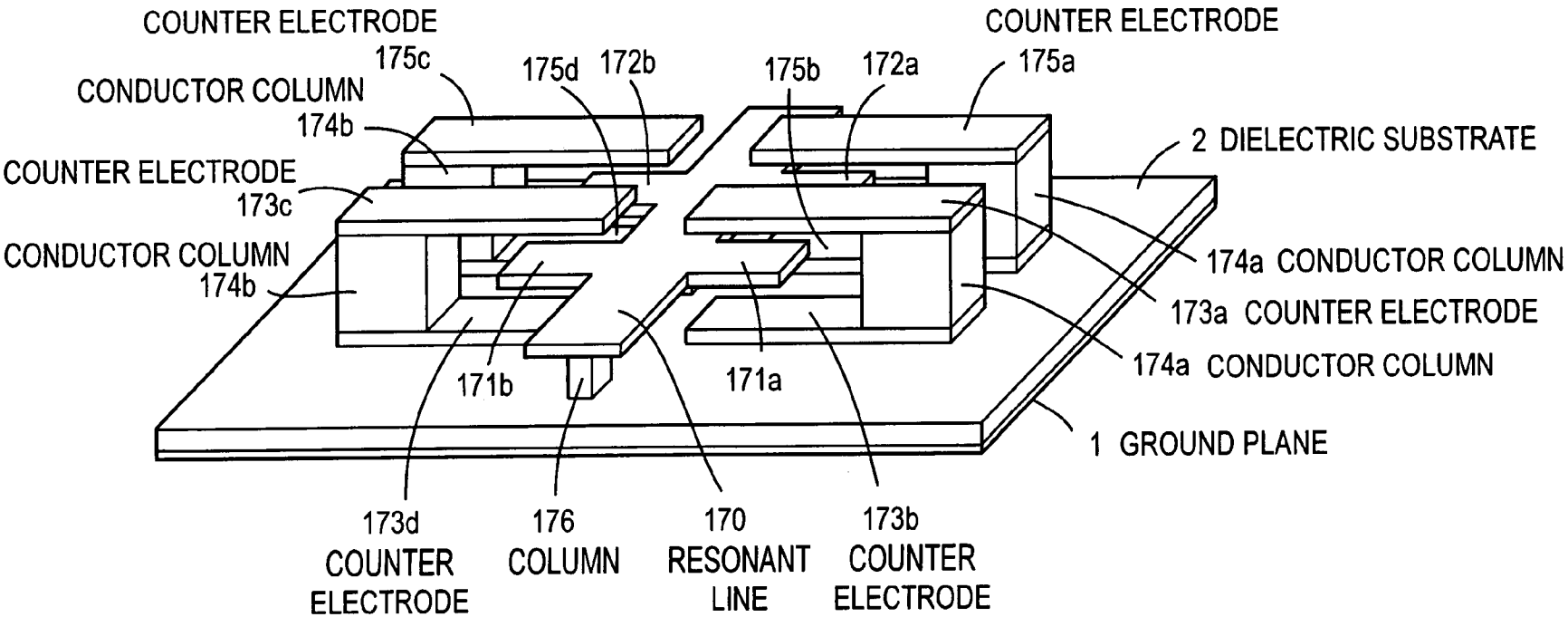
FIG. 22 shows an example of a resonant line of the present invention, provided with a hollow structure.

FIG. 22 shows another embodiment of a resonator having a lower loss structure, and of the counter electrode. FIG. 22 is an example in which the resonant line explained in FIG. 8 is made to have a hollow structure in order to reduce the dielectric loss. In FIG. 22, a part of a resonant line 170 of the resonator is shown, and the illustration of the input/output line and the structure of the tip of the resonant line is omitted. On the dielectric substrate 2, a column 176 is arranged on the dielectric substrate 2, by which a part of the resonant line 170 is supported, and the resonant line 170 is positioned in a hollow part. Another column is on the extension line (not shown) in the longitudinal direction of the line, and supports the resonant line 170. The resonant line 170 has widened parts 171*a*, 171*b* utilizing the skin effect, projected at a fixed interval in the direction perpendicular to the longitudinal direction of the resonant line. On the dielectric substrate 2 facing the position of the widened parts 171*a*, 171*b*, counter electrodes 173*b*, 173*d* facing the surface of the widened parts 171*a*, 171*b* on the side of the dielectric substrate 2 are formed. Conductor columns 174*a*, 174*b* are arranged at the end of the counter electrodes 173*b*, 173*d* on the side opposite the resonant line 170. The counter electrodes 173*a*, 173*c* facing the surface of the widened parts 171*a*, 171*b* on the side opposite the dielectric substrate 2, are formed at the other ends of the conductor columns 174*a*, 174*b*. That is, the widened parts 171*a*, 171*b* are sandwiched from the upper and lower sides by the counter electrodes 173*b*, 173*d* on the dielectric substrate 2, and by the counter electrodes 173*a*, 173*c* connected with the conductor columns 174*a*, 174*b*. Widened parts 172*a*, 172*b* are formed at a fixed interval from the widened parts 171*a*, 171*b*. Similarly, in the widened parts 172*a*, 172*b*, the widened part 172*a* is sandwiched by the counter electrodes 175*a* and 175*b* from the upper and lower sides. Likewise, the widened part 172*b* is sandwiched by the counter electrodes 175*c* and 175*d* from the upper and lower sides.

In the case where the resonant line 170 is arranged in the hollow part in this way, it is possible to reduce the dielectric loss caused in the dielectric substrate 2, as compared with the case of forming the resonant line 170 on the dielectric substrate 2. In addition, since the counter electrodes 173*a*, 173*b*, 173*c*, 173*d* can be arranged on the upper and lower sides of the widened parts 171*a*, 171*b* of the resonant line 170, the area of counter electrodes facing the resonant line 170 can be increased to enable a larger capacitance Ca to be formed with the same size, as a result of which a smaller resonator can be made.

Figure 23:
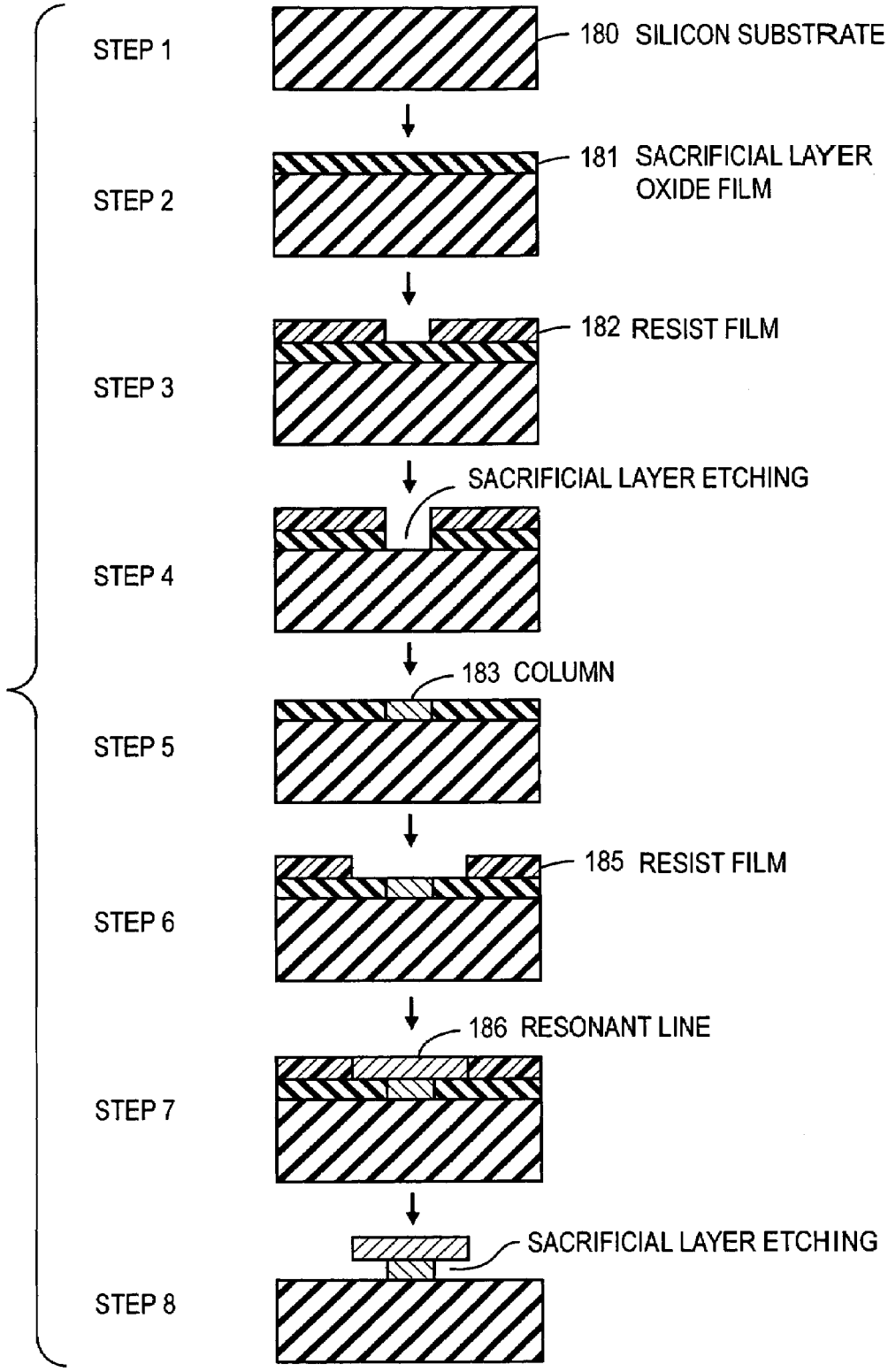
FIG. 23 is a schematic process chart showing a method for making a hollow electrode.

Here, a method for making the hollow electrode is explained. FIG. 23 is a schematic process chart showing the method for making the hollow electrode. The resonator and the variable resonator of the present invention can be manufactured in a semiconductor process. Step 1 in FIG. 23 shows a silicon substrate 180 on which the resonator is formed. A sacrificial layer oxide film 181 is formed on the whole surface on the silicon substrate 180 (step 2). Next, in order to form a column supporting a hollow electrode, a resist film 182 from which a desired portion is removed, is formed on the sacrificial layer oxide film 181 by a photolithographic process using a photomask (step 3). Then, the resist film 182 is removed and a directly exposed portion of the sacrificial layer oxide film 181 is removed by an etching process (step 4). Next, an embedded column 183, which serves as a column part here, is formed from a metallic material and the like through an electroplating process in the part from which the sacrificial layer oxide film 181 is removed (step 5). Next, a resist film 185 from which only a part for forming a resonant line is removed, is formed by the photolithographic process using a photomask for forming the resonant line (step 6). Next, a metallic material and the like is embedded through the electroplating process into the part from which the resist film 185 is removed, so as to form a resonant line 186 (step 7). Finally, the hollow electrode, in the present example, the resonant line 186 is formed by removing the resist film 185 and the sacrificial layer oxide film 181 by the etching process (step 8).

As described above, it is possible to form a three dimensional structure on a silicon substrate by repeating the process for forming a flat sacrificial layer oxide film on the silicon substrate, and the photolithographic process for selectively removing the sacrificial layer oxide film. FIG. 22 shows an example in which the counter electrodes 173*a*, 173*b* and the counter electrodes 173*c*, 173*d* are divided into two sets sandwiching the resonant line 170, but since electrodes can be formed by the above described manufacturing process, a constitution connecting the counter electrodes 173*a*, 173*b* with each other can be easily formed. As described above, the method for making electrodes supported in the hollow part is explained, but it is also possible to constitute the resonator and the variable resonator of the present invention as a whole on the silicon as a semiconductor material.

Figure 24:
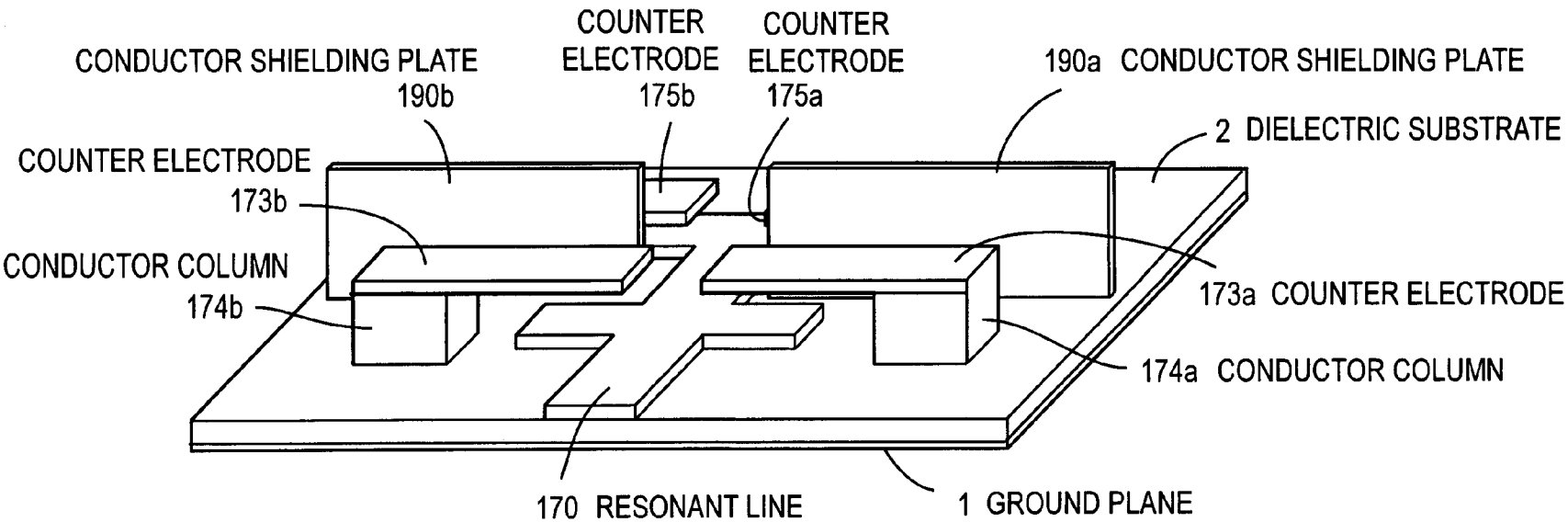
FIG. 24 shows an example in which shielding conductor plates are formed between the counter electrodes.

In addition, a relatively tall structure, for example a conductor shielding plate for preventing the electromagnetic coupling between counter electrodes, can be easily formed on the dielectric substrate. FIG. 24 shows an example in which the conductor shielding plate is formed between the counter electrodes. Since FIG. 24 is the same as FIG. 22 except that the columns supporting resonator line are not provided, that the shape of the counter electrode is different, and that the conductor shielding plate is formed, explanation of those denoted by the same reference numbers as in FIG. 24 is omitted. In FIG. 24, conductor shielding plates 190*a*, 190*b* are inserted between the counter electrodes 173*a*, 173*b* and between the counter electrodes 175*a*, 175*b*. The conductor shielding plates 190*a*, 190*b* are conductively connected with the ground plane 1 by Via holes (not shown). With this arrangement, it is possible to shield the coupling between the adjacent electrodes, which coupling adversely affects the resonator.

Embodiments with the microstrip line structure is shown in the above explanation of the resonator and the variable resonator of the present invention, but the present invention is not limited to the embodiments, and a resonator and a variable resonator can also be similarly constituted in a coplanar waveguide.

Embodiment 7

Figure 25:
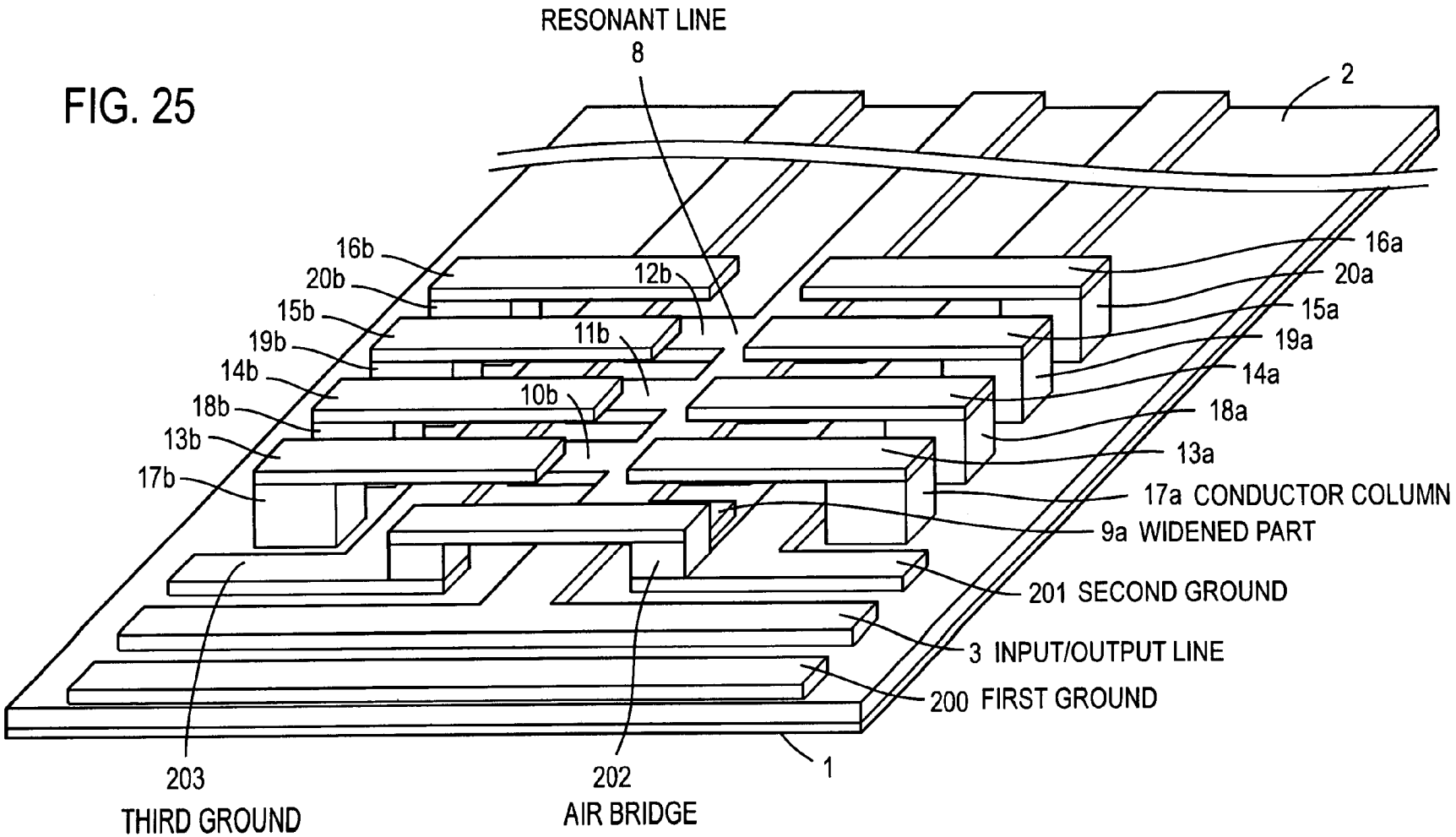
FIG. 25 shows an embodiment in which a resonator of the present invention is formed by using a coplanar waveguide.

FIG. 25 shows an embodiment in which a resonator of the present invention is formed by using a coplanar waveguide. The resonator using the coplanar waveguide shown in FIG. 25 has essentially the same constitution as that of the resonator explained in FIG. 8, except only that the coplanar waveguide is used. Thus, the same components as those in FIG. 8 are denoted by the same reference numbers and explanation of the components is omitted. The input/output line 3 in which a signal is inputted from one end and outputted from the other end, is sandwiched in a plane between the first ground 200 and the second ground 201, so as to be formed as a coplanar waveguide. The first ground 200 is arranged in parallel with and outside the input/output line 3, and the second ground 201 is arranged on the side of the resonant line 8. The second ground 201 is extended by a fixed length in parallel with the input/output line 3, and thereafter extended between the conductor column 17*a* and the widened part 9*a* of the resonant line 8, in parallel with the resonant line 8. That is, the second ground 201 is extended in the direction perpendicular to the input/output line 3. One end of an air bridge 202 which is formed from a conductive material and which is three-dimensionally strides over the resonant line 8, is connected to the corner part in which the second ground 201 is bent at right angle. The air bridge 202 is connected to the third ground 203 which is positioned symmetrically across the resonant line 8. The third ground 203 is formed into a shape symmetrical to the second ground 201 across the resonant line 8, and is provided with the part extended in parallel with the input/output line 3 similarly to the second ground 201 and with a part extended between the conductor column 17*b* and the widened part 9*b* in parallel with the resonant line 8.

In this way, the resonator and the variable resonator of the present invention can be constituted with the coplanar waveguide. This example, in which a resonator is constituted, may be changed into a variable resonator by additionally providing the switches as shown in FIG. 9 and FIG. 10. The details of the variable resonator are omitted because they are explained using FIG. 9 and FIG. 10.

Figure 26:
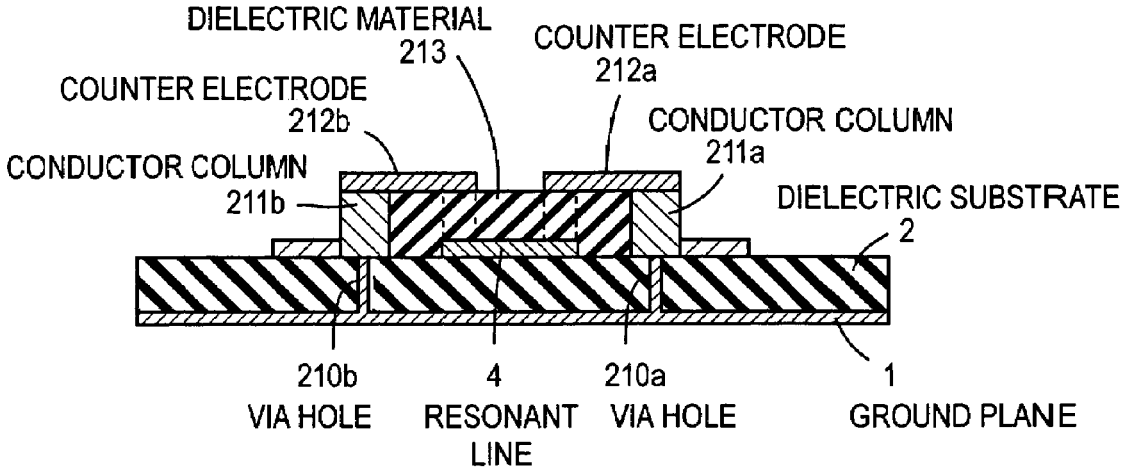
FIG. 26 shows an embodiment in which a dielectric material is provided between the counter electrode and the resonant line.

In the above explanation, an air gap is formed between the counter electrode and the resonant line, but a method as shown in FIG. 26 can be considered, in which a dielectric material is provided between the counter electrode and the resonant line. FIG. 26 shows a sectional view of an embodiment of the resonator of the present invention. On both sides of the resonant line 4, conductor columns 211*a*, 211*b* are arranged. The conductor columns 211*a*, 211 *b* are grounded by the ground plane 1 through Via holes 210*a*, 210*b*. The counter electrodes 212*a*, 212*b* are arranged at positions facing the resonant line 4 with an interval approximately equal to the height of conductor columns 211*a*, 211*b*. The dielectric material 213 is filled in the space between the counter electrodes 212*a*, 212*b* and the resonant line 4. The capacitance Ca can be larger to an extent of the relative dielectric constant of the dielectric material 213 in the space between the counter electrodes 212*a*, 212*b* and the resonant line 4, as compared with the case where only air is present in the space. This method in which the front and rear sides of the resonant line 4 are covered by a dielectric, is conflicting with the method for reducing the dielectric loss in the resonant line as described above. However, this method has advantages that the capacitance Ca can be made large, and that the counter electrodes 212*a*, 212*b* as a whole can be held by the dielectric material 213, thereby enabling the structural strength to be increased. In the embodiment shown in FIG. 26, the dielectric material 213 is also arranged the space between the conductor columns 211*a*, 211*b* and the resonant line 4. This causes a dielectric loss to be generated when a high frequency signal propagates between the resonant line 4 and the conductor columns 211*a*, 211*b*. There is a method in which the dielectric material 213 is arranged only in the spaces (portion indicated by broken lines in FIG. 26) between the counter electrodes 212*a*, 212*b* and the resonant line 4 in FIG. 26, in order to prevent the generation of the dielectric loss.

In the above described embodiments, there are shown, as a structure of the supporting part for supporting the counter electrodes, the structure in which the counter electrode is supported by the supporting part formed by a conductor and at the same time is grounded by the ground surface, and the structure in which the supporting part is formed from a dielectric (or semiconductor) and the grounding conductor is provided along the wall of the dielectric. The mechanical strength of the conductor column generally formed from a metallic material is weaker than that formed from a dielectric.

Figure 27A:
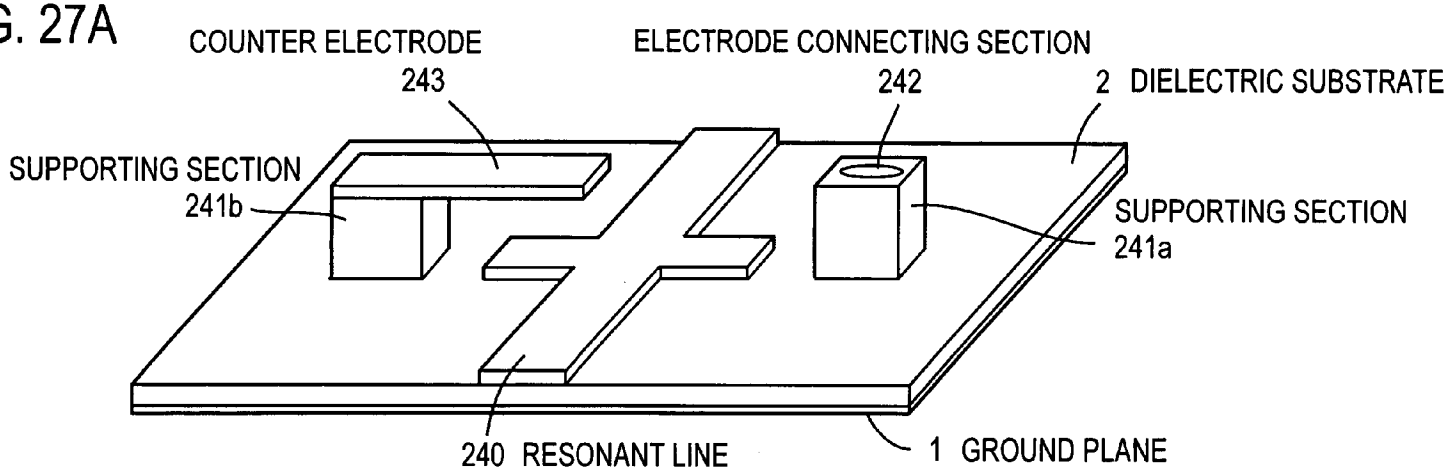
FIG. 27A shows an embodiment of a structure in which an electrode connecting part is provided in a supporting part.
Figure 27B:
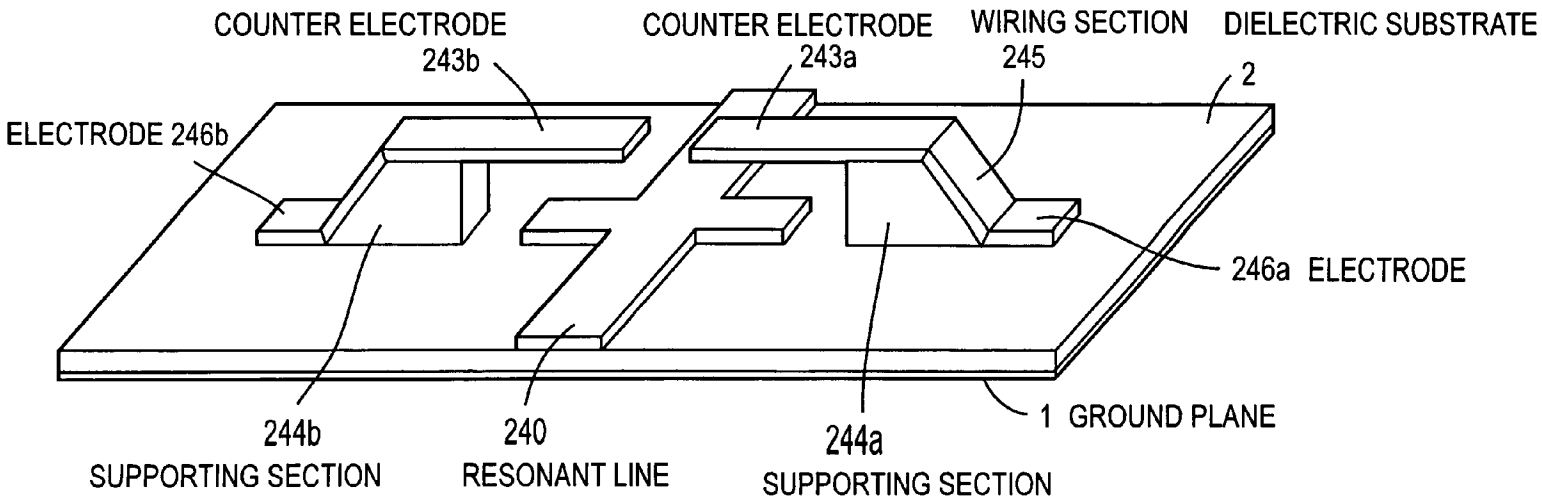
FIG. 27B shows an embodiment of a structure in which a wiring part is provided outside the supporting part.

Thus, structures as shown in FIG. 27A and FIG. 27B are considered as a structure of the supporting part. FIG. 27A is an embodiment in which an electrode connecting part 242 is provided in the supporting part 241*a*. FIG. 27A is a figure showing a part of the resonant line 240, and showing only parts different from the above described embodiments. The counter electrode on the side of the supporting part 241*a* is omitted for explanation. The electrode connecting part 242 effects electric connection between the counter electrode (not shown) and the ground plane 1. In other words, the electrode connecting part 242 performs the function of the Via hole. The electrode connecting part 242 is surrounded by the supporting part 241*a* formed from a dielectric material. The above described constitution makes it possible to further increase the mechanical strength of the supporting part compared with the case where the counter electrode is supported only by the electrode connecting part 242.

FIG. 27B shows essentially the same constitution of the column and the contact electrode as those explained in FIG. 9. A counter electrode 243*a* and an electrode 246*a* electrically connected with the ground plane 1 through a Via hole (not shown) are electrically connected with each other through a wiring part 245 formed on the inclined surface of a supporting part 244*a*. Such constitution makes it possible to increase the mechanical strength of the supporting part similarly to the case shown in FIG. 27A.

It is also possible to realize an extremely low loss resonator by forming the resonator and the variable resonator of the present invention from a superconducting material. In particular, the variable resonator of the present invention, of which insertion loss is not sensitive to the ON resistance of the switch, can further exhibit the low loss feature of the present invention, by using the superconducting material capable of dramatically reducing the line resistance that is mainly responsible for the insertion loss.

With the above described constitutions according to the present invention, since the resonant line constituting the resonator, and the counter electrode facing the resonant line are arranged adjacent to each other, a capacitive reactance is additionally provided in parallel with the resonator, and even in the case where the resonant frequency is desired to be made low, the plane size of the resonator need not be increased and the size of the substrate in the thickness direction needs to be only slightly and partially increased.

What is claimed is:

1. A resonator, comprising:

a substrate formed from a dielectric or a semiconductor;

an input line, formed on the substrate, configured to receive a signal inputted into the input line;

a resonant line, formed on the substrate, coupled to said input line and configured to resonate with the signal inputted into said input line;

an output line, formed on the substrate, coupled to said resonant line and configured to receive an output of said resonant line;

a ground formed on the substrate;

at least one counter electrode arranged on a same side of the substrate as the resonant line so as to overlap said resonant line with a constant space in between in a direction perpendicular to said substrate, and configured to form a reactance between the resonant line and the at least one counter electrode;

at least one supporting member configured to support the at least one counter electrode on said substrate; and at least one conductor connecting the at least one counter electrode to the ground.

2. The resonator of claim 1, wherein said at least one counter electrode is provided for an antinode part of a voltage standing wave generated in said resonant line.

3. The resonator of claim 1, wherein said resonant line is a quarter wavelength line, of which a tip is grounded, and said at least one counter electrode is provided for a part of said resonant line, which part is present at a distance of not smaller than ⅛ wavelength and not larger than ¼ wavelength from the grounded tip of said resonant line.

4. The resonator of claim 1, wherein said resonant line is a half wavelength line, of which a tip is grounded, and said at least one counter electrode is provided for a part of said resonant line, which part is present at a distance of not smaller than ⅛ wavelength and not larger than ⅜ wavelength from the grounded tip of said resonant line.

5. The resonator of claim 1, wherein said resonant line is a quarter wavelength line, of which a tip is opened, and said at least one counter electrode is provided for a part of said resonant line, which part is present at a distance of not larger than ⅛ wavelength from the tip of said resonant line.

6. The resonator of claim 1, wherein said resonant line is a half wavelength line, of which a tip is opened, and said counter electrode is provided for parts of said resonant line, which parts are present at a distance of not larger than ⅛ wavelength from the tip of said resonant line, and at a distance of not smaller than ⅜ wavelength and not larger than ½ wavelength from the tip of said resonant line.

7. The resonator of claim 1, wherein an air gap formed between said resonant line and said at least one counter electrode is 10 μm or less.

8. The resonator of claim 1, wherein said resonant line is held with an interval against said substrate, and a plurality of said at least one counter electrode is provided on the same side of said substrate with respect to the resonant line, and on the opposite side of the substrate with respect to the resonant line, respectively.

9. The resonator of claim 1, wherein said at least one supporting member comprises:

a supporting part configured to support said at least one counter electrode; and an electrical connection part formed in said supporting part, and configured to electrically connect the at least one counter electrode to a ground plane.

10. The resonator of claim 1, wherein said at least one supporting member comprises:

a supporting part configured to support said at least one counter electrode; and a wiring part formed on a surface of said supporting part, and configured to electrically connect the at least one counter electrode to an electrode connected with a ground plane.

11. The resonator of claim 1, wherein a dielectric is provided between said resonant line and said at least one counter electrode.

12. The resonator of claim 1, wherein a plurality of said at least one counter electrode are arranged in a lengthwise direction of said resonant line, and a grounded conductor shielding plate is provided between said counter electrodes adjacent to each other in the lengthwise direction of said resonant line.

13. The resonator of claim 1, wherein the input line is magnetically coupled with the resonant line, and the resonant line is magnetically coupled with the output line.

14. The resonator of claim 1, wherein the input line is coupled with the resonant line in a first electric field, and wherein the resonant line is coupled with the output line in a second electric field.

15. A resonator, comprising:

a substrate formed from a dielectric or a semiconductor;

an input line, formed on the substrate, configured to receive a signal inputted into the input line;

a resonant line, formed on the substrate, coupled to said input line and configured to resonate with the signal inputted into said input line;

an output line, formed on the substrate, coupled to said resonant line and configured to receive an output of said resonant line;

a ground formed on the substrate;

at least one counter electrode arranged on a same side of the substrate as the resonant line so as to overlap said resonant line with a space in between in a direction perpendicular to said substrate, and configured to form a reactance between the resonant line and the at least one counter electrode;

at least one supporting member configured to support the at least one counter electrode on said substrate; and at least one conductor between the at least one counter electrode and the ground, wherein said resonant line has a main resonant line part with a first width $W_1$ as a line width in a direction parallel to said input and output lines, and widened parts with a second width $W_2$ wider than the width $W_1$, the main resonant line part and the widened parts are alternately arranged at least once, and said at least one counter electrode is arranged to face said widened parts having the second width $W_2$.

16. The resonator of claim 15, wherein a width difference between the first width $W_1$ and the second width $W_2$ of said resonant line is not smaller than a skin depth of a signal of a resonance frequency and a frequency in a vicinity of the resonance frequency, and a length of said second width $W_2$ in the direction perpendicular to said input and output lines is not smaller than the skin depth of the signal of the resonant frequency and the frequency in the vicinity of the resonance frequency, and is not larger than a quarter of the wavelength of the resonance frequency.

17. A resonator, comprising:

a substrate formed from a dielectric or a semiconductor;

an input line, formed on the substrate, configured to receive a signal inputted into the input line;

a resonant line, formed on the substrate, coupled to said input line and configured to resonate with the signal inputted into said input line;

an output line, formed on the substrate, coupled to said resonant line and configured to receive an output of said resonant line;

a ground formed on the substrate;

at least one counter electrode arranged on a same side of the substrate as the resonant line so as to overlap said resonant line with a constant space in between in a direction perpendicular to said substrate, and configured to form a reactance between the resonant line and the at least one counter electrode;

at least one supporting member configured to support the at least one counter electrode on said substrate;

at least one switch configured to control whether the at least one counter electrode is connected to the ground or not; and at least two conductors connecting the at least one counter electrode to one port of the at least one switch and connecting another port of the at least one switch to the ground.

18. A resonator comprising a plurality of the resonator of claim 17, wherein an output line of one of said resonant lines and an input line of another of said resonant lines are connected in cascade via a capacitive coupling element.

19. The resonator of claim 17, wherein said at least one counter electrode is arranged in a direction perpendicular to a lengthwise direction of said resonant line.

20. The resonator of claim 19, wherein an electrostatic capacitance between each of said at least one counter electrode and the resonant line is equal to each other.

21. The resonator of claim 19, wherein an electrostatic capacitance between each of said at least one counter electrode and the resonant line is changed in accordance with an amplitude of a voltage standing wave.

* * * * *